US006436696B1

(12) United States Patent
Hsieh et al.

(10) Patent No.: US 6,436,696 B1
(45) **Date of Patent: *Aug. 20, 2002**

(54) ENZYME TREATMENT TO ENHANCE WETTABILITY AND ABSORBANCY OF TEXTILES

(75) Inventors: You-lo Hsieh, Davis, CA (US); Mary Michelle Hartzell, Logan, UT (US); Matthew G. Boston, San Carlos, CA (US); Kathleen A. Clarkson, San Francisco, CA (US); Katherine D. Collier, Redwood City, CA (US); Thomas P. Graycar, Pacifica, CA (US); Edmund A. Larenas, Moss Beach, CA (US)

(73) Assignees: The Regents of the University of California, Oakland, CA (US); Genencor International, Inc., Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/472,660

(22) Filed: Dec. 27, 1999

Related U.S. Application Data

(60) Division of application No. 08/952,617, filed on Mar. 16, 1998, now Pat. No. 6,066,494, which is a continuation-in-part of application No. 08/611,829, filed on Mar. 6, 1996, now abandoned.

(51) Int. Cl.[7] ..... C12S 11/00; C09B 67/00

(52) U.S. Cl. ..... 435/263; 8/401; 8/115.54; 8/DIG. 4

(58) Field of Search ..... 435/262, 263, 435/264, 277, 279, 198; 8/138, 401, 115.51, 115.7, 115.54, DIG. 4; 510/300, 305, 306, 310–323, 530

(56) References Cited

U.S. PATENT DOCUMENTS

| | | | | |
|---|---|---|---|---|
| 4,008,044 A | * | 2/1977 | Latta et al. | |
| 4,294,576 A | | 10/1981 | Helfert et al. | 8/137 |
| 4,415,428 A | | 11/1983 | Nochumson et al. | 204/299 |
| 5,234,463 A | | 8/1993 | Sando et al. | 8/138 |
| 5,352,243 A | | 10/1994 | Ashikawa et al. | 8/401 |
| 5,460,966 A | * | 10/1995 | Dixon | |

FOREIGN PATENT DOCUMENTS

| | | | | |
|---|---|---|---|---|
| DE | 42 28 785 A1 | | 3/1994 | |
| EP | 0 476 915 A2 | | 9/1991 | C11D/3/386 |
| EP | 0 662 540 A1 | | 12/1994 | D06M/16/00 |
| EP | 0 687 729 A1 | | 6/1995 | C12N/11/12 |
| GB | 1 442 418 A | * | 7/1976 | |
| JP | 3-167366 | | 7/1991 | |
| JP | 3-167378 | | 7/1991 | |
| JP | 04-126869 | | 4/1992 | |
| JP | 5-344897 A | * | 5/1993 | |
| JP | 6-220772 | | 8/1994 | |
| JP | 6-264359 | | 9/1994 | |
| WO | WO93/13256 | | 7/1993 | |
| WO | WO-93/13256 A1 | * | 7/1993 | |
| WO | WO 94/12578 | | 6/1994 | C09B/67/00 |
| WO | WO96/13632 | | 5/1996 | |
| WO | WO-97/27237 A1 | * | 7/1997 | |

OTHER PUBLICATIONS

Sato. SEN–I Gakkaishi. vol. 39, No. 5 (1983), pp. T209–T219.*

Kawabata, et al., "Application of enzymes to textile industry," *Senshoku Kogyo, Drying Industry*, 444, 38(8):47–52 (1990).

Kawabata, et al., *Chemical Abstracts*, (Jan. 28, 1991) 114(4):77, Abstract No. 114:25677m.

Achwal, W.B., Enzymatic removal of cotton pectin, *Coulorage*, 35 (1992).

Kirk–Othmer, "Textiles. Survey," *Encyclopedia of Chemical Technology*, John Wiley & Sons, 22:762–772 (1993).

Bach, E., et al., "Comparsion of the alkaline boiling–off process against the enzymatic elimination of the accompanying substances of cotton, " *Excerpts from the Dissertation of Elke Bach* (1993).

Röbner, U., "Enzymatic degradation of impurities in cotton," *Melliand Textilberichte*, 74:144–148 (1993).

Kirk–Othmer, "Enzyme applications (Industrial), " *Encyclopedia of Chemical Technology*, John Wiley & Sons, 9:602–604 (1994).

Cheshkova, et al., "Use of an enzyme–containing formulation for treatment of cotton textiles," *Chemical Abstracts*, (Feb. 21, 1994) 120(8):127–128, Abstract No. 120:79317m.

* cited by examiner

*Primary Examiner*—William H. Beisner
(74) *Attorney, Agent, or Firm*—le;.5qTownsend and Townsend and Crew LLP

(57) ABSTRACT

Textile fibers are treated with enzymes in the absence of surfactants, with the effect of increasing the wettability and absorbency of the fibers. The enzymes are pectinases, cellulases, proteases, lipases or combinations thereof. The wetting properties of cotton fibers are found to be most substantially improved by treatment with a mixture of cellulase and pectinase. The effects of five hydrolyzing enzymes on improving the hydrophilicity of several polyester fabrics have been studied. Four out of the five lipases studied improve the water wetting and absorbent properties of the regular polyester fabrics more than alkaline hydrolysis under optimal conditions (3N NaOH at 55° C. for 2 hours). Compared to aqueous hydrolysis, the enzyme reactions have shown to be effective under more moderate conditions, including a relatively low concentration (0.01 g/L), a shorter reaction time (10 minutes), at an ambient temperature (25° C.). Contrary to the results with alkaline hydrolysis, the improved water wettability is accompanied by full strength retention. Lipase has also shown to be effective in improving the wetting and absorbent properties of sulfonated polyester and microdenier polyester fabrics.

12 Claims, 12 Drawing Sheets

ENZYME TREATMENT TO ENHANCE WETTABILITY AND ABSORBANCY OF TEXTILES

CROSS REFERENCE TO RELATED APPLICATIONS

This application is a Division of U.S. Ser. No. 08/952,617, filed Mar. 16, 1998, now U.S. Pat. No. 6,066,494, which is a Continuation-in-Part of U.S. Ser. No. 08/611,829, filed Mar. 6, 1996, now abandoned, the disclosures of both of which are herein incorporated by reference for all purposes.

FIELD OF THE INVENTION

This invention resides in the field of textile processing, and also in the use of enzymes.

BACKGROUND OF THE INVENTION

Fibers and fabrics of cotton and other textile materials are not suitable for dyeing or finishing in their raw state since they have low wettability, as evidenced by contact angles in the range of 93° to 95°, and low water retention, typically on the order of 0.15 mL of water per mg of fiber or less. In cellulose-based fibers, these characteristics are attributed to the non-cellulosic impurities in the materials. The impurities are typically of a wax-like or oily nature. Removal of these non-cellulosics is achieved in textile processing by alkaline scouring, which is performed by immersing the materials in boiling caustic solution. Alkaline scouring consumes both time and energy, and produces waste water containing considerable quantities of salts after the used alkali has been neutralized.

Synthetic fibers such as polyester have similarly high water contact angles, low wettability and minimal water retention. In contrast to cellulose-based fibers, these effects are not caused by the presence of impurities, but are rather an inherent characteristic of the polyester surface. If it is desired to dye the polyester fabric, the situation is further complicated as standard polyester fibers, and fabrics made from these fibers, have no reactive dye sites. Polyester fibers are typically dyed by diffusing dyes into the amorphous regions of the fibers. Methods have also been developed for improving dye uptake and other properties of polyester by modifying the surface of the fibers.

The modification of the surface of polyester fibers by physical or chemical means is known. For example, anionic sites have been added to polyester fibers using 5-sulfoisophthalate as a method to make polyester fibers reactive towards cationic dyestuffs. Similar to the procedure followed with cellulosic fibers, the surface of polyester fibers has been modified by alkaline treatment of freshly extruded fiber to improve comfort and increase water sorption. Disclosures of these treatments are found in U.S. Pat. No. 5,069,846 and U.S. Pat. No. 5,069,847. Alkali treatment of polyesters, however, often results in a weakening of the fiber strength.

Enzymes have been used in the textile industry and various uses are disclosed in the literature. The enzymes commonly used include amylases, cellulases, pectinases and lipases. In typical applications, amylases are used to remove sizing agents (e.g., starch), cellulases are used to alter the surface finish of, or remove impurities from, cotton fibers and lipases are used to remove fats and oils from the surface of natural fibers (e.g., cotton, silk, etc.).

Amylases are used to remove sizes from fabrics, the sizes having been applied to the yarns prior to weaving to prevent the warp yarns from damage during weaving. The size is removed prior to further finishing processes such as bleaching or dyeing. The most common sizing agent is starch. Examples of commercially available α-amylases include AQUAZYM® and TERMAMYL® (Novo Nordisk A/S).

Enzymes have also been used for denim garment finishing, to achieve soft hand and the fashionable worn look traditionally obtained by stone-washing and acid washing. The enzymes used for this purpose are microbial cellulases.

Another use of cellulases in the treatment of cotton is disclosed by Rössner, U., "Enzymatic degradation of impurities in cotton," *Melliand Textilberichte* 74:144–8 (1993) (*Melliand English* 2/1993: E63–E65). The cellulases in the Rössner disclosure were used as a replacement for alkali. The cellulases were used in combination with surface-active agents, whose inclusion was apparently thought necessary to achieve wettability. The treatment solutions also contained an unspecified buffer. The enzyme reactions were terminated by washing at boil for an unspecified time. The stated purpose of the enzyme treatment was to improve the quality of the finished goods by dehairing, smoothing and internal softening. No mention is made of permanently improving the wettability or absorptivity of the goods.

Pectinases have been used to remove polysaccharide impurities from fibers such as ramie, flax, hemp and jute by incubating the fiber with an aqueous solution of the enzyme at, for example, 40° C. at a pH of 4.7 for 24 h (JP 4289206).

The use of lipases to remove oily stains from garments is known in the detergent art (e.g., U.S. Pat. No. 4,810,414). Lipases have also been used in textile finishing. For example, Petersen discloses treating natural fibers with lipases to remove residual triglycerides and other fatty materials. The process is also useful for removing oil or ester coatings that have been added during processing (WO 93/13256). No mention is made in Petersen of using lipases to alter the properties of a polyester fiber by cleaving structural ester bonds at the surface of the fiber. Lund, et al. disclose the use of lipases in organic solution to modify with carboxylic acids the surfaces of certain fabrics. The lipases are used to form esters between the carboxylic acids and fibers which have reactive hydroxyl groups at their surface (WO 96/13632).

The alkali processing of fibers using NaOH has several inherent disadvantages. The use of large quantities of boiling aqueous sodium hydroxide is undesirable for reasons of safety, convenience and also for the volume of waste salt which is produced following neutralization of the alkali bath. The use of hot alkali to treat fibers also results in damage to the fibers which lessens their strength and durability. Thus, a means for treating fabrics to increase their wettability and absorbency which avoided the use of an alkali bath would constitute a considerable advance in the field of textile processing. Quite surprisingly, the instant invention provides such a means.

SUMMARY OF THE INVENTION

It has now been discovered that water wettability and absorbency in textile fibers can be increased by treatment with any of four classes of enzymes. Pectinases, cellulases, proteases and lipases, either alone or in combination, and either as the sole treatment step or following a brief boiling treatment in neutral water, have been found to produce water wettability and whiteness that are either equivalent or superior to the wettability and whiteness achieved by alkaline scouring. The enzymes eliminate the need for the high pH entailed in alkaline scouring, and avoid alkaline discharges.

The enzymes can also eliminate the need for surfactants and the associated costs, and the enzyme treatment can be conducted at moderate temperatures. It has in fact been found that the enzyme treatment of fabrics without surfactants lowers the contact angle considerably and the resulting fabrics can absorb about 25% to 40% more water than fabrics that are treated by alkaline scouring.

Thus, in one embodiment, the instant invention provides a method of altering water wettability and absorbency in textile fibers, comprising treating the fibers with an enzyme in an aqueous medium, the enzyme being a member selected from the group consisting of pectinases, cellulases, proteases, lipases, and combinations, thereof and the aqueous medium being substantially free of surface active agents.

It has now been found that pectinases and cellulase in combination are particularly useful in increasing the water wettability and water retention of cotton fabrics. Thus, in a second embodiment, the invention provides a method of increasing water wettability and absorbency in cotton fibers, comprising treating the cotton fibers with an enzyme mixture further comprising a pectinase and a cellulase, in an aqueous medium.

In another embodiment, lipases have been shown to dramatically improve the wettability and water retention of aromatic polyester fibers while, in contrast to the techniques of the prior art, causing a minimal loss of fiber weight and strength. Therefore, in yet another embodiment, the instant invention is a method of altering the physical properties of polyester fibers, comprising treating the polyester fibers with an aqueous solution of a lipase to produce polar groups on the fiber. The polar groups on the fiber can modify physical properties of the fiber including its wettability and absorbency. Within the scope of this embodiment of the invention is the use of surfactants as a component of the reaction medium.

These and other features and advantages of the invention will become apparent from the description that follows.

a. water contact angle b. water retention c. thickness

Figure 4:
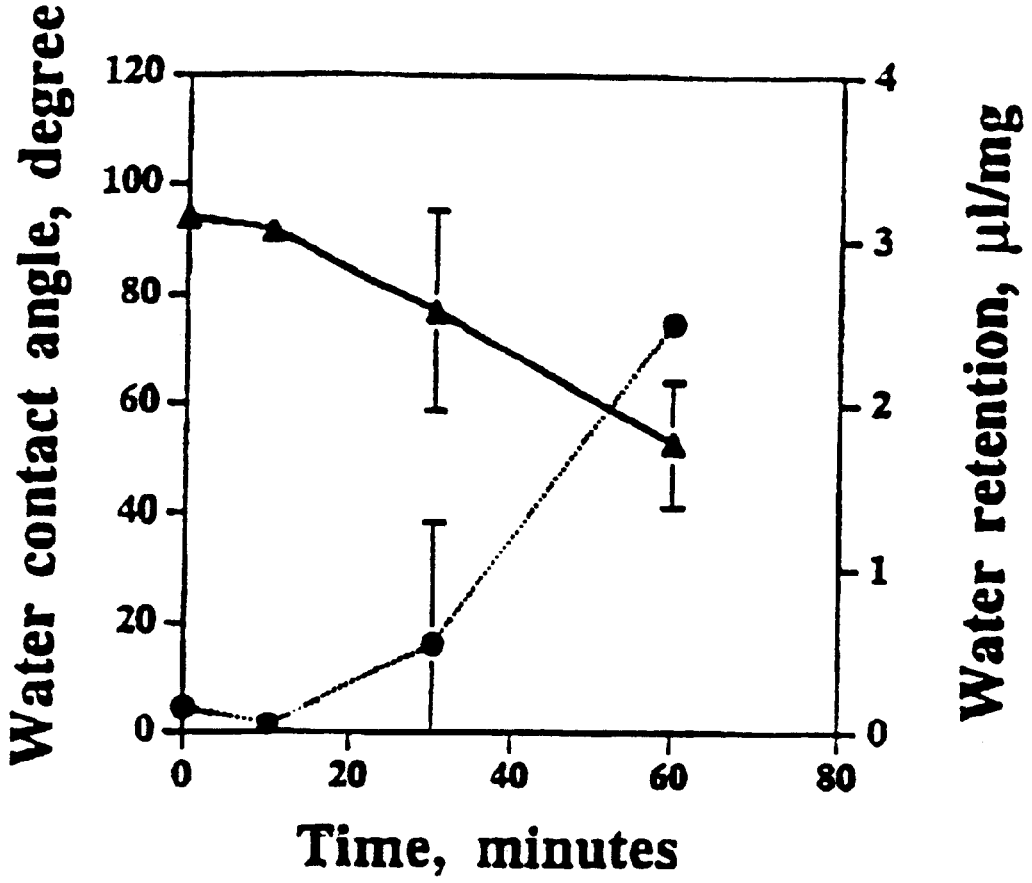
Figure 5:
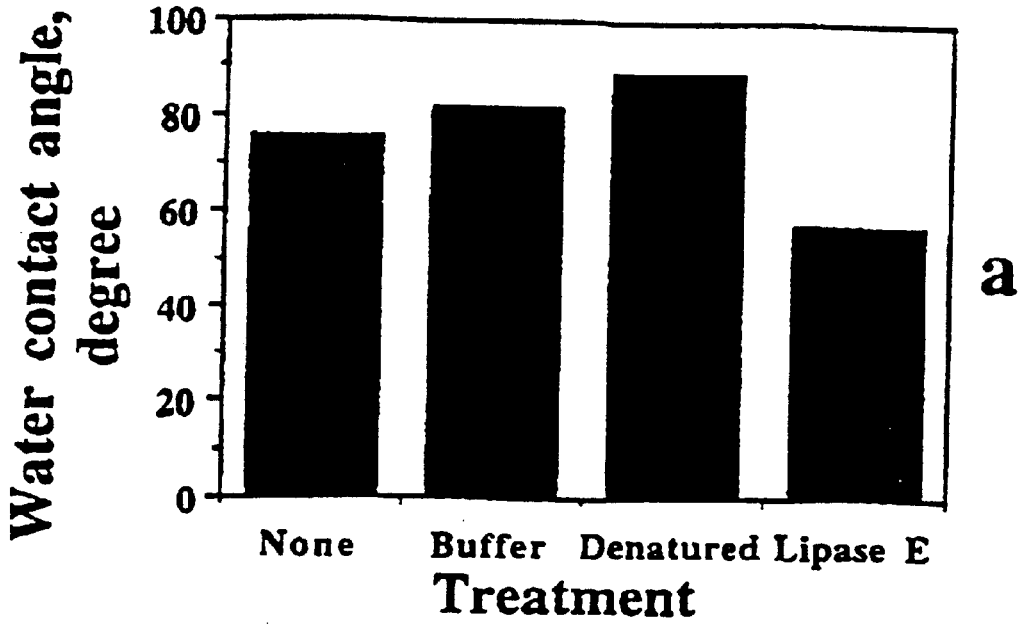
Figure 5:
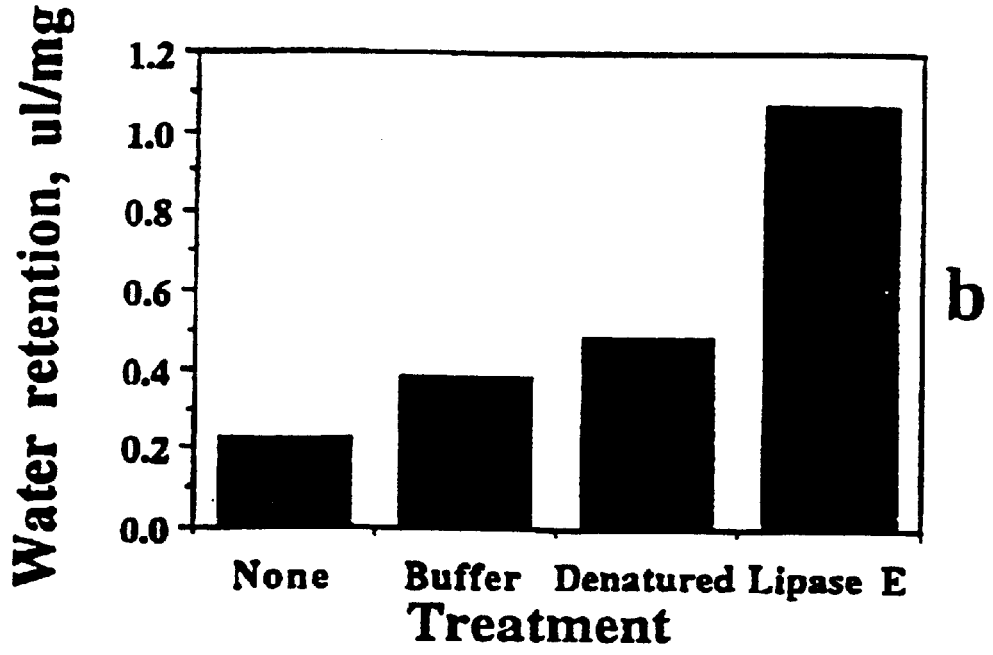

FIG. 4. Wettability of cotton fabrics treated with 100° C. water and pectinase for varying times ▼ water contact angle ● water retention FIG. 5. Effects of buffer, denatured lipase, and lipase E on water wetting contact angle and water retention of PET fabric.

Figure 6:
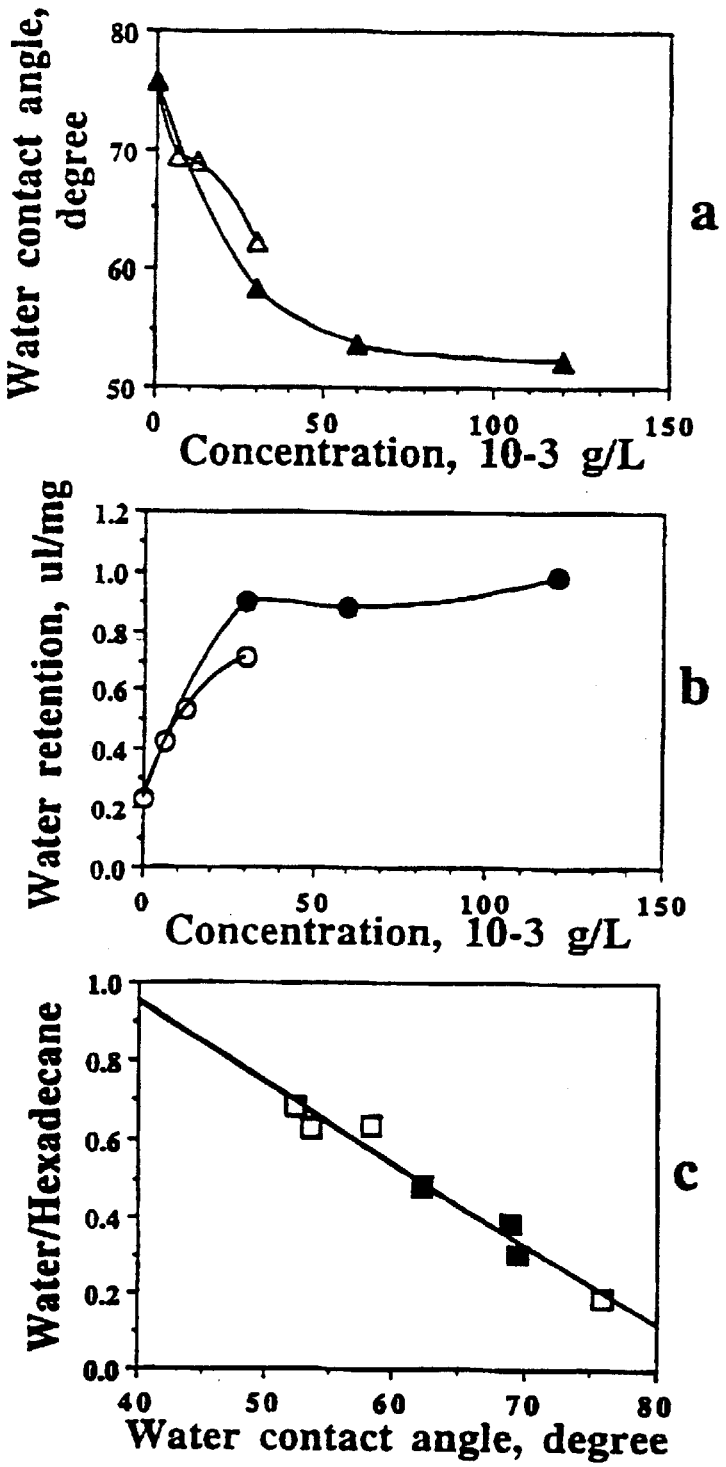

FIG. 6. Effects of lipase E concentration and reaction temperature on water wetting and water retention properties of PET fabric.

Figure 7:
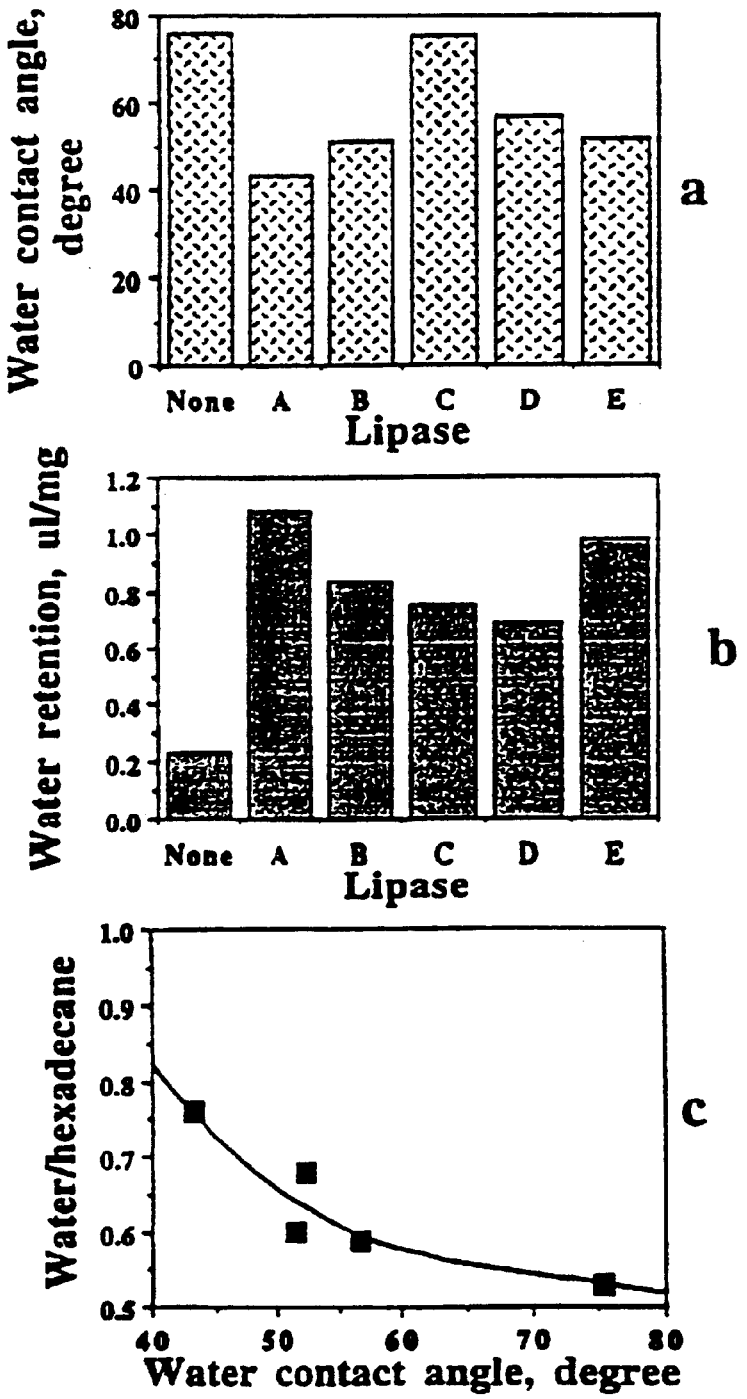
Figure 8:
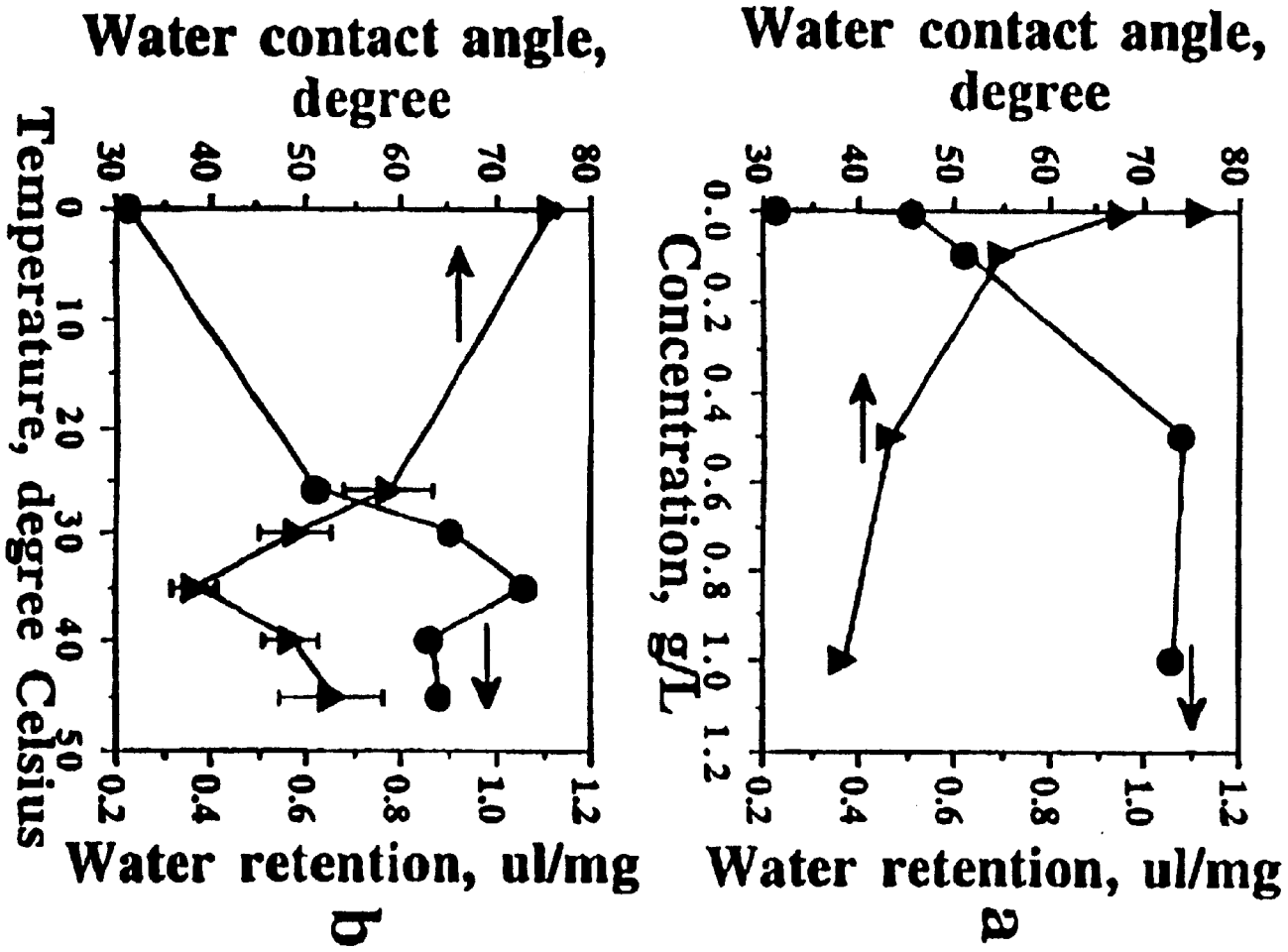

FIG. 7. Comparison of commercially available lipases on the water wetting and water retention properties of PET fabric FIG. 8. Concentration and temperature effects of lipase A in buffer on water wetting and water retention properties of PET fabric.

Figure 9:
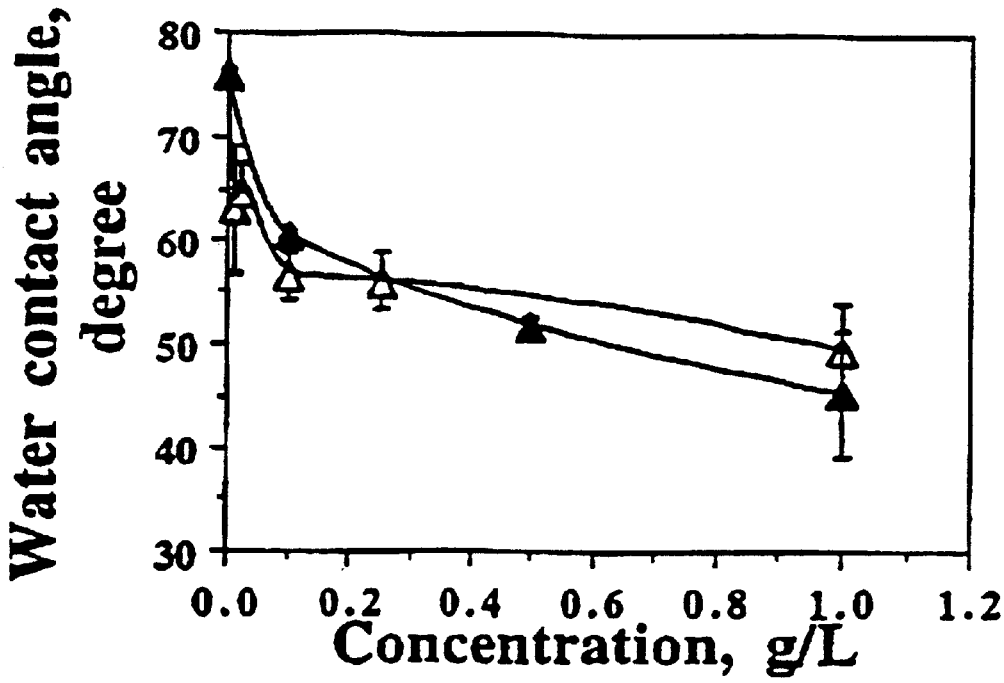

FIG. 9. Concentration and temperature effects of lipase A in water on water wetting and retention properties of PET fabric

Δ25° C.

▼ 35° C.

Figure 10:
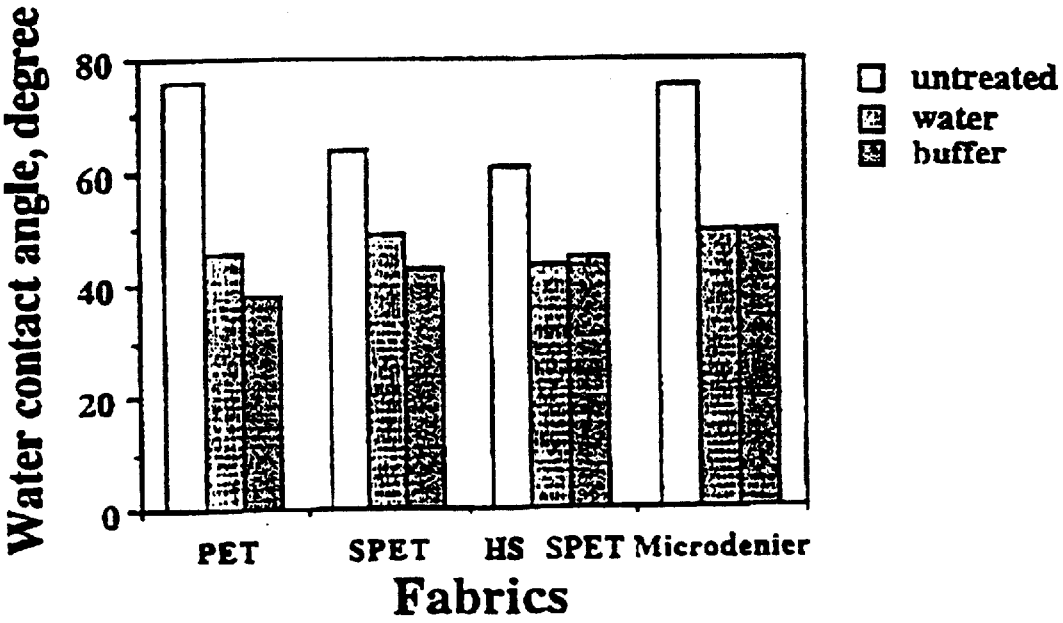

FIG. 10. Effects of lipase A on water wetting and retention properties of four PET fabrics:

PET regular polyester or Dacron 54

SPET-sulfonated polyester or Dacron 64

HS SPET—heat set SPET

Microdenier—micromatique polyester

Figure 11:
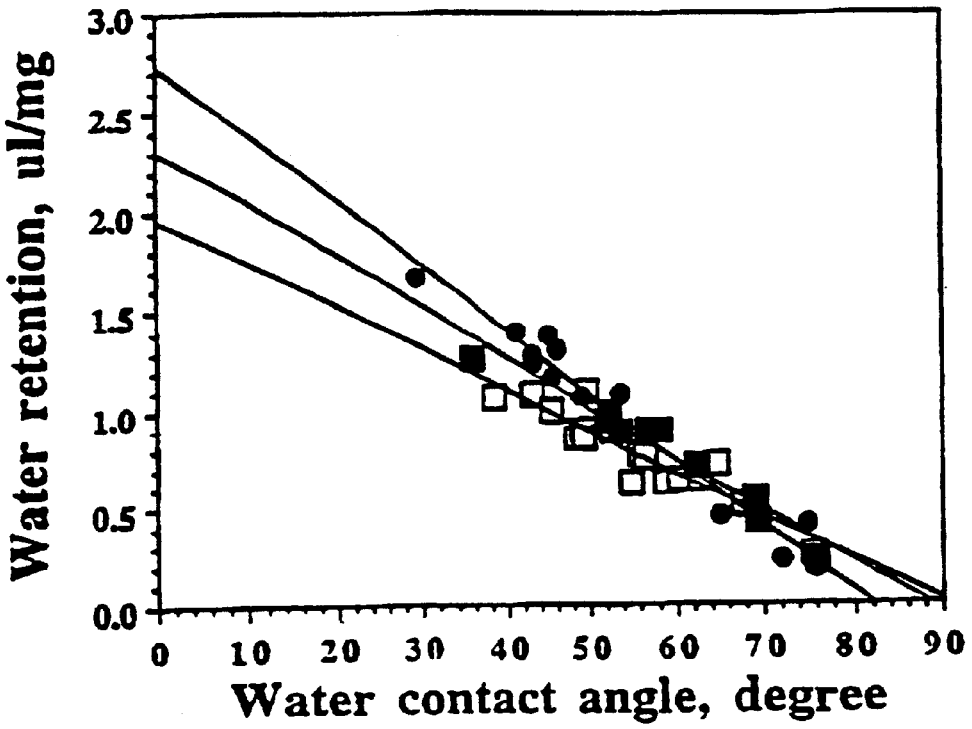
Figure 12:
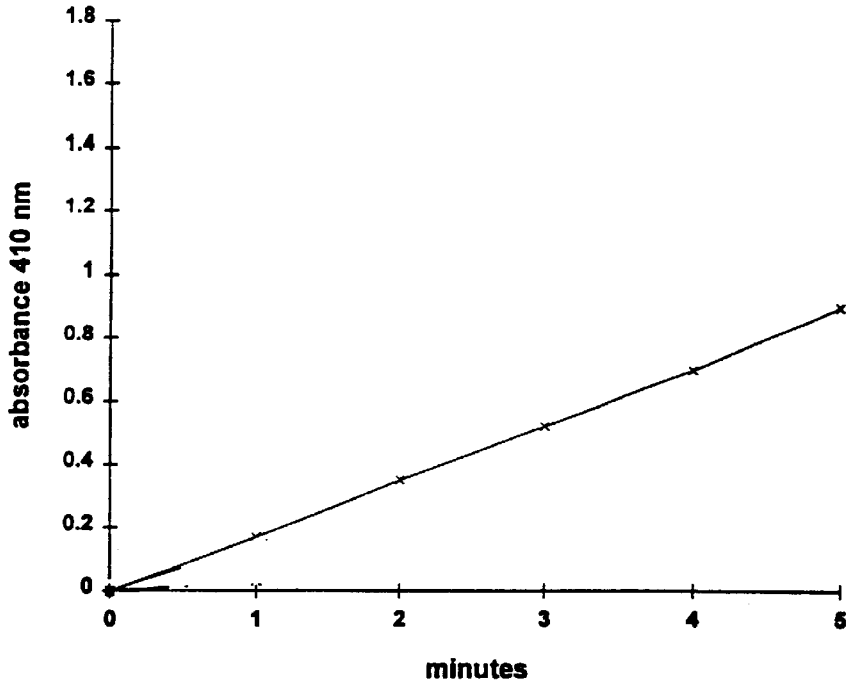

FIG. 11. Relationships between water retention and water wetting contact angle of modified PET fabrics:

- • alkaline hydrolysis of PET and mPET fabrics, $y=2.73-0.0033\,x$, $r=0.982$
- ■ lipase E treatment of PET fabric, $y=2.31-0.0026\,x$, $r=0.971$
- □ PET, SPET, and mPET fabrics treated with lipase A, $y=1.96-0.0022\,x$, $r=0.943$ FIG. 12. Rates of chromogenic substrate conversion of various lipases bound to polyester fabric.

DETAILED DESCRIPTION OF THE INVENTION AND PREFERRED EMBODIMENTS

Pectinases (also known as pectic enzymes) useful in the practice of this invention include pectinesterases and pectic depolymerases. Examples of pectic depolymerases are endopolygalactouronase, endopectate lyase, endopectin lyase, exopolygalactouronase, and exopectate lyase. Sources of pectinesterases are higher plants, numerous fungi (including some yeasts) and certain bacteria. Sources of pectic depolymerases are plant-pathogenic and saprotrophic fungi as well as bacteria and yeasts.

Examples of cellulases useful in this invention are endoglucanase, exoglucanase, and β-glucosidase. "Cellulolytic enzymes" or "Cellulase enzymes" means fungal exoglucanases or exo-cellobiohydrolases, endoglucanases, and β-glucosidases. These three different types of cellulase enzymes act synergistically to convert cellulose and its derivatives to glucose.

A cellulase composition produced by a naturally occurring source and which comprises one or more cellobiohydrolase type and endoglucanase type components wherein each of these components is found at the ratio produced by the source is sometimes referred to herein as a "complete cellulase system" or a "complete cellulase composition" to distinguish it from the classifications and components of cellulase isolated therefrom, from incomplete cellulase compositions produced by bacteria and some fungi, from a cellulase composition obtained from a microorganism genetically modified so as to overproduce, underproduce, or not produce one or more of the cellobiohydrolase type and/or endoglucanase type components of cellulase, or from a truncated cellulase enzyme composition. For example, analysis of the genes coding for CBHI, CBHII, EGI, EGII and EGV in *Trichoderma longibrachiatum* shows a domain structure comprising a catalytic core region or domain (CCD), a hinge or linker region (used interchangeably herein) and cellulose binding region or domain (CBD). Truncated enzymes, i.e., an expression product comprising the catalytic core domain in the absence of the binding domain, are useful in the treatment of textiles and are considered within the scope of the invention.

Preferred for use in this invention are cellulases derived from plant, fungal or bacterial sources. Specific examples of fungal cellulases include those derived from Trichoderma sp., including *Trichoderma longibrachiatum, Trichoderma viride, Trichoderma koningii*, Penicillium sp., Humicola, sp., including *Humicola insolens*, Aspergillus sp., and Fusarium sp. Bacterial cellulases are derived from such organisms as Thermomonospora sp., Cellulomonas sp., Bacillus sp., Pseudomonas sp., Streptomyces sp., and Clostridium sp. Other organisms capable of producing cellulases useful in preparing cellulase compositions described herein are disclosed in British Pat. No. 2 094 826A and PCT Publication No. 96/29397, the disclosures of which are herein incorporated by reference.

Proteases (also known as peptidases) useful in this invention include serine peptidases, examples of which are trypsin, chymotrypsin and subtilisins; thiol proteases, examples of which are bromelain and papain; aminopeptidases; and carboxypeptidases. Proteases are obtainable from a wide variety of sources. Proteases useful in practicing the methods of the invention include for example, those disclosed in U.S. Pat. No. 4,990,452, which is herein incorporated by reference.

Lipases are obtainable from milk, yeasts, bacteria, wheat germ, animal sources (e.g., pancreas) and various fungi. Examples of lipases of use in practicing this invention include those obtained from Candida, Pichia, Streptomyces, Bacillus, Pseudomonas, Mucor, Rhizopus and extracts from the pancreas of common livestock (e.g., pigs, sheep, cattle, etc.). Examples of useful lipases are disclosed in U.S. Pat. No. 5,278,066, which is herein incorporated by reference.

Enzymes useful in the present invention may be prepared according to methods well known in the art. For example, it is possible to produce native state or wild type enzyme compositions utilizing standard fermentation and purification protocols. Such fermentation procedures for culturing enzyme producing microorganisms, including fungi and bacteria, to produce enzymes useful in the present invention are known per se in the art. For example, cellulase, lipase, protease and pectinase compositions can be produced either by solid or submerged culture, including batch, fed-batch and continuous-flow processes. The collection and purification of such produced enzymes from the fermentation broth can also be effected by procedures known per se in the art. Enzyme compositions incorporated within the fermentation matrix specific to an organism can be obtained by purification techniques based on their known characteristics and properties. For example, substantially pure component enzymes, be they cellulase, protease, pectinase or lipase, may be obtained by recognized separation techniques published in the literature, including ion exchange chromatography at a suitable pH, affinity chromatography, size exclusion and the like. For example, in ion exchange chromatography (usually anion exchange chromatography), it is possible to separate enzyme components by eluting with a pH gradient, or a salt gradient, or both a pH and a salt gradient. After purification, the requisite amount of the desired components could be recombined.

Additionally, it is possible to genetically engineer a microorganism to overproduce a specific enzyme, or to produce it in the absence of other enzymes or protein contaminants. Similarly, it is possible to produce mutant enzymes which have additional valuable characteristics for textile applications such as, thermostability, alkaline or acid stability, surfactant stability, increased pH range or increased activity. Such enzymes are further within the scope of the invention.

It should be noted that it is not the source of the enzyme which is critical to the present invention but the activity it presents to the relevant substrate. Accordingly, any enzyme composition having the appropriate activity profile may be selected for a given application under the present teaching. Of course, the selection of the specific enzyme for a specific application should take into consideration the conditions under which it is used, the selection being advantageously improved by matching the biochemical characteristics, e.g., pH optimum, temperature optimum, ion and salt effects, to the specific conditions under which the enzyme will be used. Enzymes within the scope of this invention can also be obtained from commercial suppliers. Some of these suppliers are ICN Biomedicals, Costa Mesa, Calif., USA; Sigma Chemical Company, St. Louis, Mo, USA and Novo Nordisk Biotech, Inc., Denmark and Genencor International Inc., Rochester, N.Y., USA.

Buffers useful in the present invention are those art recognized acid/base reagents which stabilize the enzyme composition against undesired pH shifts during treatment of the fiber, fabric or yarn. In this regard, it is recognized that many enzyme activities are pH dependent. For example, a specific enzyme composition will exhibit enzyme activity within a defined pH range with optimal enzymatic activity generally being found within a small portion of this defined range. The specific pH range for enzymatic activity will vary with each enzyme composition. Moreover, during enzyme treatment of the fiber, fabric or yarn, it is possible that the pH of the initial reaction could be outside the range required for activity. It is further possible for the pH to change during treatment of the fiber, fabric or yarn, for example, by the generation of a reaction product which alters the pH of the solution. In either event, the resultant pH of an unbuffered enzyme solution could be outside the range required for activity. When this occurs, undesired reduction or cessation of activity occurs.

In view of the above, the pH of the enzyme solution should be maintained within the range required for activity. One means of accomplishing this is by simply monitoring the pH of the system and adjusting the pH as required by the addition of either an acid or a base. However, in a preferred embodiment, the pH of the system is preferably maintained within the desired pH range by the use of a buffer in the enzyme solution. In general, a sufficient amount of buffer is employed so as to maintain the pH of the solution within the range wherein the employed enzyme exhibits activity. Insofar as different enzyme compositions have different pH ranges for exhibiting activity, the specific buffer employed is selected in relationship to the specific enzyme composition employed. The buffer(s) selected for use with the enzyme composition employed can be readily determined by the skilled artisan taking into account the pH range and optimum for the enzyme composition employed as well as the pH of the solution.

Preferably, the buffer employed is one which is compatible with the enzyme composition in terms of the presence of ions or salts and which will maintain the pH of the solution within the pH range required for optimal activity. Suitable buffers include sodium citrate, ammonium acetate, sodium acetate, disodium phosphate and others. Examples of organic buffers useful in practicing the invention include potassium hydrogen phthalate, potassium hydrogen tartrate, acetic acid, sodium acetate and tri(hydroxymethyl) aminomethane. Examples of inorganic buffers of use in practicing the invention include sodium phosphate and potassium phosphate (including the mono- and di-protic salts), sodium carbonate, sodium bicarbonate and sodium borate. The buffering agents are preferably inorganic buffers.

The fiber, fabric or yarn is incubated with the enzyme solution under conditions effective to allow the enzymatic action to confer the desired effect to the fabric. For example, during enzyme treatment, the pH, liquor ratio, temperature and reaction time may be adjusted to optimize the conditions under which the enzyme acts. "Effective conditions" necessarily refers to the pH, liquor ratio, and temperature which allow enzyme to react efficiently with the substrate. The reaction conditions for any particular enzyme are easily ascertained using well known methods.

Accordingly, the pH of the solution into which a specific enzyme is added will necessarily be dependent on the identity of the specific enzyme. With respect to fungal cellulases, where the cellulase is derived from *Trichoderma longibrachiatum*, it is preferable to hold the pH of the solution to the acid to neutral range of from about 4–7, whereas cellulase from *Humicola insolens* will operate effectively in the neutral range, i.e., from about 6–8. On the other hand, if cellulase from bacterial sources is used, i.e., Bacillus, it is possible to use much higher pH levels, in the range of about 6–11. With respect to lipases, Applicants refer to Tables 1–3 which provide numerous examples of lipase compositions useful at a variety of pH and temperatures. Pectinase and protease compositions are similarly useful at a variety of pH levels. However, pectinases are often useful when used at pH levels of about 4–6 and many proteases, i.e., those from Bacillus sp., i.e., lentus are useful at alkaline pHs of from about 7–11.

In certain applications it is desirable to use enzymes which are active at either basic or acidic pH values. The invention encompasses varying the pH of the reaction mixture and, where required, the identity (or source) of the enzyme in order to achieve the desired effect on the fabric. Thus, for example, lipases which are active at different pH values can be utilized in order to achieve the desired reaction conditions and hence, the desired fabric properties. Tables 1, 2 and 3 provide examples of lipases which are active over different pH ranges and which, when taken together, afford an arsenal of lipases which can be used under quite variable conditions. The choice of lipases to illustrate the variety of conditions under which different enzymes useful in practicing the invention are reactive is intended for illustration only and is not meant to either define or limit the scope of the invention.

TABLE 1

Temperature and pH optima for selected lipases

| Isolate (Pseudomonas) | pH optimum | Temperature optimum (° C.) |
|---|---|---|
| Ps. *seruginosa* (10145) | 8.8–9.1 | 40 |
| Ps. *fluorescens* | 8 | 55 |
| Ps. *fluorescens* (MC50) | 8–9 | 30–40 |
| Ps. *fluorescens* (AFT29) | 7.0 | 22 |
| Ps. *fluorescens* (AFT38) | 8 | 35 |
| Ps. *fragi* (2239B) | 9.5 | 75–80 |
| Ps. *cepacia* (DSM50181) | 5.0 | 60 |
| Ps. *nitroreducens* | 9.5 | 75–80 |
| Ps. sp. (KWI-56) | 5.5–7.0 | 60 |
| Ps. sp. (1-8-24) | 7 | 60 |

TABLE 2

Microorganisms that produce lipases active at pH 5.5 but not at pH 7.5

| Microorganisms | NRRL number |
|---|---|
| *Candida ancudensis* | Y-17327 |
| *Candida antarctica* | Y-7954 |
| *Candida atmaspherica* | Y-5979 |
| *Candida bombi* | Y-17081 |
| *Candida buffonii* | Y-17082 |
| *Candida cacaoi* | Y-7302 |
| *Candida chilensis* | Y-17141 |
| *Candida geochares* | Y-17073 |
| *Candida lipolytica* | Y-2178 |
| *Candida magnoliae* | Y-2024, Y-2333, YB-4226, Y-7621, Y-7622 |
| *Candida maritima* | Y-7899 |
| *Candida salmanticensis* | Y-17090 |
| *Candida savonica* | Y-17077 |
| *Pichia glucozyma* | YB-2185 |
| *Pichia musicola* | Y-7006 |
| *Pichia petersonli* | YB-3808 |
| *Pichia silvicola* | Y-1678 |
| *Pichia sydowiorum* | Y-7130 |
| *Saccharomycopsis fibuligera* | Y-12677 |
| *Chainia purpurogena* | B-2952 |
| *Streptomyces auerus* | B-16044 |
| *Streptomyces flavovirens* | B-2685 |
| *Alcaligenes faecalis* | B-1695 |
| *Bacillus amyloliquefaciens* | B-207 |
| *Bacillus megaterium* | B-1827, B-1851, B-352, B-47 |
| *Bacillus subtilis* | B-554 |
| *Pseudomonas acidovorans* | B-980 |
| *Pseudomonas aeruginosa* | B-23, B-248, B-79, B-27 |
| *Pseudomonas chlororaphis* | B-1869, B-2075 |
| *Pseudomonas fluorescens* | B-1608, B-1897, B-258, B-2640, B-97 |
| *Pseudomonas fragi* | B-955 |
| *Pseudomonas myxogenes* | B-2108 |
| *Pseudomonas putida* | B-1245, B-13, B-2023, B-2174, B-2336, B-254, B-805, B-931, B-2079, B-8 |
| *Pseudomonas putrifaciens* | B-9517 |
| *Pseudomonas reptilovora* | B-6, B-712 |
| *Pseudomonas syncyanea* | B-1246 |
| *Pseudomonas viscosa* | B-2538 |

TABLE 3

Microorganisms that produce lipases active at pH 7.5 but not at pH 5.5

| Microorganisms | NRRL number |
|---|---|
| YEASTS | |
| *Pichia alni* | Y-11625 |
| *Pichia membranaefaciens* | Y-1513 |
| *Pichia meyerae* | Y-12777 |
| *Saccharomycopsis crataegensis* | YB-192 |
| BACTERIA | |
| Altermonas spp. | B-956, B-973 |
| *Bacillus amyloliquefaciens* | B-1466, B-2613 |
| *Bacillus circulans* | B-383 |
| *Bacillus magaterium* | B-938 |
| *Pseudomonas aeruginosa* | B-221 |
| *Pseudomonas chloroaphis* | B-1541, B-1632 |
| *Pseudomonas fragi* | B-2316, B-73 |
| *Pseudomonas myxogenes* | B-2105 |
| *Pseudomonas perolens* | B-1123 |
| *Pseudomonas reptilovora* | B-1961 |
| *Pseudomonas septica* | B-1963, B-2082 |
| *Pseudomonas stutzeri* | B-775 |
| ACTINOMYCETES | |
| *Rhodococcus rhodochrous* | B-16562 |
| *Streptomyces albus* | B-2380 |
| FUNGUS | |
| *Penicillium citrinum* | 6336 |

The quantity of enzyme in the treatment solution can vary and is not critical to the invention, other than the expectation that stronger solutions will be effective in shorter treatment times. Within the scope of the instant invention is the use of various menas known to and used by those of skill in the art for determining protein concentration, e.g., Lowry method, COOMASSIE® Blue method, etc. Similarly, it will be recognized by those of skill in the art that the activity of the enzymes can be determined by methods which are standard in the art. The enzyme concentrations can fall within the range of about 0.0001 g/L to about 5.0 g/L. In most cases, the enzyme concentration will fall within the range of about 0.0001 g/L to about 1.0 g/L. Pectinases and cellulases are preferably within the range of about 0.1 g/L to about 1.0 g/L. Lipases are preferably within the range of about 0.01 g/L to about 1.0 g/L, and most preferably within the range between about 0.01 g/L to about 0.2 g/L. Proteases are preferably within the range of about 0.01 g/L to about 0.1 g/L.

The treatment solution is most often an aqueous solution of the enzyme and a buffer, however, the enzyme can also be used in aqueous solution without buffer. The treatment solution can contain additional ingredients, although preferably only the enzyme and buffer are present. In general, the treatment solution does not contain a surfactant. When a lipase is used to treat polyester, however, a surfactant can be included in the treatment medium.

The optimal treatment temperature will vary with the type and source of enzyme utilized. Reaction temperatures useful for enzyme compositions are governed by two competing factors. Firstly, higher temperatures generally correspond to enhanced reaction kinetics, i.e., faster reactions, which permit reduced reaction times as compared to reaction times required at lower temperatures. Accordingly, reaction temperatures are generally at least about 10° C. and greater. Secondly, many enzymes, as proteins, lose activity beyond a given reaction temperature which temperature is dependent on the nature of the enzyme used. Thus, if the reaction temperature is permitted to go too high, then the desired enzymatic activity is lost as a result of the denaturing of the enzyme.

The range of useful temperature is between from about 10° C. to about 90° C., and will most often be within the range of about 20° C. to about 60° C. Pectinases, cellulases and proteases, as exemplified herein, are preferably used at temperatures of about 35° C. to about 60° C., while lipases, as exemplified herein, are preferably used at temperatures of about 20° C. to about 35° C. These temperature ranges are provided as examples only and it is within the scope of this invention to utilize enzymes which are active at temperatures outside these temperature ranges. For example, as shown in Table 1, lipases from different sources are known to be active over a temperature range of from about 22° C. to about 80° C. Moreover, the use of enzymes from thermophilic, alkalophilic or acidophilic organisms will provide the opportunity to use quite extreme conditions during processing of the textile. It is within the scope of the instant invention to vary both the reaction temperature and the enzyme used to achieve the desired effect on the fabric being processed.

The optimal treatment time will vary based on the type and source of the enzyme utilized and the enzyme activity and concentration in the treatment solution, as well as the temperature and pH at which treatment is performed. In most cases, it is desirable to obtain effective treatment within a time frame of from about 10 minutes to about 1 hour. Preferred reaction times are within the range of from about 5 minutes to about 30 minutes, with a time of about 10 minutes being most preferred.

Termination of the enzyme treatment can be achieved either by removing the fibers from contact with the enzyme, or preferably by shifting the pH or temperature of the treatment solution to a range within which the enzyme is inactive. In other aspects of the invention, the reaction is terminated by removing the fabric from the reaction medium and washing the fabric in a buffer having a pH at which the enzyme is unstable or inactive. Thus, reactions on fabric treated with enzymes that are active under acidic conditions can be terminated by immersing or washing the fibers in a basic buffer, while reactions on fabric using enzymes which are active under basic conditions can be terminated by immersing or washing the fibers in an acidic buffer.

For those embodiments of the invention in which the enzyme treatment is preceded by placing the textile material in boiling water, the water used in the boiling treatment can be plain water or an aqueous buffer solution. The pressure under which boiling is performed is not critical, and atmospheric pressure will generally be the most convenient. The length of time for the boiling treatment is not critical, although best results will generally be obtained with boiling times of at least about 0.1 minute, preferably from about 0.3 to about 6 minutes.

The textile materials to which the invention is applicable include fibers, yarns and fabrics comprising either natural or synthetic fibers and blends containing two or more different types of fibers. Examples of natural fibers are vegetable fibers such as cotton, linen, hemp, flax, jute and ramie; and animal fibers such as wool mohair, vicuna and silk. Examples of synthetic fibers are rayon and TENCEL® (regenerated cellulose), acetate (partially acetylated cellulose derivative), solvent spun cellulose (lyocel), triacetate (fully acetylated cellulose derivative), azlon (regenerated protein), acrylic (based on polyacrylonitrile), aramid (based on aromatic poylamides), nylon (based on aliphatic polyamides), olefin (based on polyolefins such as polypropylene), aromatic polyester (based on a polyester of an aromatic dicarboxylic acid and a dihydric alcohol), spandex (based on segmented polyurethane), and vinyon (based on polyvinyl chloride). Textile materials of particular interest are cotton and polyester. Preferred enzyme treatments for cotton are pectinase treatments, cellulase treatments, and treatments comprising a combination of pectinase and cellulase. Preferred enzyme treatments for polyester are lipase treatments.

When polyester materials are used in the method of the invention, this material is preferably present as a fiber, a staple fiber such as a solvent-spun fiber, a filament, a thread, a yarn or a textile fabric which may be woven, non-woven or knitted. When fibers other than polyester are utilized, the process of this invention can be applied to the fibers in the form of loose fibers or fibers combined in nonwoven, woven or knit fabrics. Woven and unwoven fabrics are preferred. It is further preferred that the fibers be substantially free of starch or other sizing material.

The following examples are offered for illustration, and are not intended to limit the scope of the invention.

EXAMPLES

These examples illustrate different types of treatment of cotton and polyester fabric, some involving enzymes in accordance with the present invention and others representing the prior art, and the effect of these treatments on the wetting and structural characteristics of the specimens. The techniques in the following Materials and Methods section were followed throughout the examples.

Materials and Methods

General

All chemicals were certified ACS grade except for reagent grade sodium phosphate (Fisher Scientific). A Millipore Mill-Q Water System was used for water purification. 15 The temperature of the reactions was monitored by an Omega temperature controller (model CN7600) with a type T copper (+)-constantan (−) teflon coated temperature probe. Mixing was aided by a top-loading low-speed Barnant mixer with a one-inch diameter blade submersed just under the liquid surface. Following treatment, the fabric were dried and the change in weight was calculated as Δ W (%):

$$\Delta\ \mathrm{Wt}(\%) = \left[\frac{(W_t - W_i)}{W_i}\right]\cdot 100 \qquad \text{eq. 1}$$

Where $W_i$ is the initial fabric weight and $W_t$ is the final fabric weight.

Fabric Characterization

Fabric count and thickness were characterized by ASTM method 1910. Yarn tensile properties were measured using an Instron tensile tester (model 1122 ™) with standard pneumatic grips (ASTM method 2256). A total of 20 warp yarns were measured at a 7.5-cm gauge length and a 200 mm/minute strain rate. The linear densities of the yarns were calculated by averaging the weights of twenty 4-cm long sections of yarns after being conditioned for at least 24 hrs. T-tests were used to determine significant differences between samples.

A Minolta spectrophotometer (model CM-2002) was used to measure the color of the fabric samples. Commission Internationale de l'Eclairage (CIE) defined L*a*b* color space values were collected using the CIE standard illuminant D (6500 K daylight) at a 10° standard observer angle. The L* values were used to describe the lightness of the fabric samples, i.e. the higher the L* value, the lighter the color. The recorded fabric color for each sample was an average of five measurements taken from five randomly selected locations on the fabric.

Water Contact Angles

Water contact angles (CAs) of fabrics were calculated from the wetting force ($F_w$) measured on a tensiometer apparatus. Detailed experimental procedures for measuring the contact angles have been described. Hsieh, Y. L., et al., *Textile Research Journal*, 62(11), 677–685 (1992). The theories underlying water contact angles and their determination have also been described. Hsieh, Y. L., *Textile Research Journal*, 65(5), 299–307 (1995). Both of these references are herein incorporated by reference. The measuring apparatus included a RG Cahn electron microbalance, a motor-mike controller (model 18008) interfaced with an Oriel reversible translator (model 16617), a Keithley autoranging multimeter (model 175), and an ABB Goerz strip-chart recorder (model SE120). The translator-controller guides the contact between the wetting liquid and the suspended fabric sample by moving the wetting liquid up to the lower edge of the fabric sample.

Two sequential wetting force measurements in water (γ=72.6 dynes/cm) and hexadecane (γ=26.7 dynes/cm) were taken to determine the water CAs for the fabric samples. The first measurement was done in water to derive the wetting force and water retention in water. The force of wetting was the difference between the advancing steady-state wetting force value, ($B_{st}$) and the weight of total liquid retained ($B_{sp}$):

$$F_w=(B_{st}-B_{sp})\cdot g \qquad \text{eq. 2}$$

$F_w$ represents the vertical force of the liquid on the fabric sample and $F_w$ is:

$$F_w=p\gamma_{LV}\cos\theta \qquad \text{eq. 3}$$

Where $\gamma_{LV}$, is the surface tension of the wetting liquid, p is the perimeter of the fabric sample, and θ is the water CA.

Following drying, a second measurement in hexadecane was used to calculate the sample perimeter and to determine the vertical liquid retention capacity of the sample. Assuming a zero CA, the perimeter of the sample was calculated from the wetting force in hexadecane ($F_{hexn}$):

$$p = \frac{F_{hexn}}{\gamma_{LV}} \qquad \text{eq. 4}$$

With known $\gamma_{LV}$ and p, the water CA can be determined from the wetting force in water ($F_w$):

$$\Theta = \left[\frac{\cos^{-1}\cdot F_w}{p\gamma_{LV}}\right] \qquad \text{eq. 5}$$

Vertical liquid retention capacity ($C_v$) and water retention ($C_m$) values were derived from the weight of the total liquid retained ($B_{sp}$) in hexadecane and water, respectively. The liquid retention C values (μl/g) were normalized by the weight of the specimen:

$$C = \frac{\left[\frac{B_{sp}}{W_5}\right]}{\rho} \qquad \text{eq. 6}$$

Where ρ is the density of hexadecane or water when deriving $C_v$ or $C_m$, respectively. The hexadecane liquid retention capacity indicates the total pore volume for liquid retention. Five measurements were taken and averaged for each fabric.

Liquid retention capacity ($C_1$) can also be calculated from fabric porosity and the densities of the liquid and solid:

$$C_1 = \frac{\rho_1}{\rho_f}\cdot\frac{\phi}{1-\phi} \qquad \text{eq. 7}$$

where $\rho_1$ is the liquid density. Furthermore, the maximum liquid retention capacity (Cm) of the fabrics can be measured by weighing the fabrics before ($W_d$ and after ($W_m$) immersion in hexadecane for 25 minutes:

$$C_m=(W_m-W_d)/W_d \qquad \text{eq. 8}$$

Cotton Fabric

In each of examples 1–4below, the effects of various conditions on cotton fabric are described. In each of these examples the cotton fabric used was a plain weave, one-hundred percent cotton fabric (Nisshinbo California Incorporated) was used in this study. Each fabric sample was cut and raveled to a dimension of 10 cm by 14 cm. A fabric piece of this dimension weighed approximately 1.5 grams. The fabric contains minimal starch sizing, as indicated by a heathered light grey light when reacted with iodine. To avoid changes to the fiber surface structure, no attempt was made to remove the sizing. Following the reactions, the cotton fabric was dried for 3 to 4 days at 65% humidity and 70° C.

Example 1

This example demonstrates the prior art technique of alkaline scouring of cotton and details the physical changes in the fabric brought about by this scouring. Scouring with NaOH caused substantial weight loss and fabric shrinkage. Scouring also improved the water contact angle and water retention of the fabric.

The unscoured fabric weighed, on average, 13.8 mg/cm$^2$, and had a thickness of 320 $\mu$m. The fabric contained 69 yarns/inch in the warp direction and 67 yarns/inch in the fill direction. The untreated cotton fabric was hydrophobic with a water CA of 93.9° (±3.3°). The fabric had a light yellow color with a L* value of 85.1.

The cotton fabric was scoured in 4% NaOH at 100° C. then rinsed with hot water until the rinse water became neutral. Equation 1 was used to calculate the percentage of fabric weight change. The physical characteristics of the scoured fabric were compared to those of the unscoured fabric. A 0.4:1 (L/g) liquor:fabric ratio was used for alkaline scouring. The NaOH treatments were performed in a 2-L kettle heated in a 2-L heating mantle. The treatment conditions and results are displayed in Table 4.

TABLE 4

Effects of alkaline scouring on fabric and yarn properties

| Scour-ing | Weight loss (%) | Thick-ness ($\mu$m) | Fabric count warp | Fabric count fill | Light-ness (L*) | Liquid retention capacity ($\mu$L/mg) | Yarn tenacity (N/tex) |
|---|---|---|---|---|---|---|---|
| None | 0.0 | 320 (9) | 68.8 (1.6) | 67.2 (0.8) | 85.1 (0.1) | 1.84 (0.07) | 9.7 (1.1) |
| 1 hr | −11.0 | 450 (28) | 74.2 (0.8) | 73.2 (1.1) | 86.9 (0.2) | 2.72 (0.05) | 8.3 (0.5) |
| 2 hr | −12.3 | 424 (12) | 73.6 (0.9) | 72.0 (0.0) | 87.4 (0.3) | 2.72 (0.08) | 8.9 (0.9) |

Scouring in a 4% sodium hydroxide solution at 100° C. for one hour caused substantial weight loss and fabric shrinkage as evidenced by the increased fabric thickness and fabric count. Fabric wettability improved with scouring. The water contact angle (43.1°) and water retention (2.87 $\mu$L/mg) were significantly improved. The fabric also became lighter in color with an increased L* value. Lengthening the scouring time to two hours caused slightly higher weight loss without further fabric shrinkage. Both wetting and lightness improved with longer scouring times, but the water retention remained the same. Importantly, scouring also reduced the strength and linear density of the yarns.

Example 2

This example details the effects of buffers on the properties of cotton fabric. In order to differentiate the effects of enzymes, the effects of the buffer-alone (without the enzyme) had to be established. Cotton fabric was treated with the three buffer solutions under the same conditions as in their respective enzyme reactions.

A 0.33:1 (L/g) liquor:fabric ratio was employed for the buffer treatments. The buffers were sodium carbonate at pH 10.5 (for protease) and two sodium phosphate buffers, one at pH 5 (for cellulase and pectinase) and the other at pH 8.5 (for lipase). In general, the buffers had little or no effect on the wetting properties of the cotton fabrics. The sodium carbonate buffer at pH 10.5 and the sodium phosphate buffer at pH 5.0 did not change the water wetting CA of cotton fabrics. The sodium phosphate buffer at pH 8.5 reduced the water CA to 83.0° which is still considerably hydrophobic. The results are summarized in Table 5.

TABLE 5

Effects of buffers on cotton

| Buffer | Temp (° C.) | Weight Loss (%) | Thickness ($\mu$m) | Fabric count warp | Fabric count fill | Lightness (*L) | Contact angle (°) | Water retention ($\mu$L/mg) | Tenacity (N/tex) |
|---|---|---|---|---|---|---|---|---|---|
| NaPhos pH 5.0 | 50 | −5.7 | 467 (20) | 72.2 (0.4) | 71.2 (0.8) | 86.7 (0.2) | 88.7 (10.9) | 0.72 (0.73) | 8.5 (1.0) |
| NaPhos pH 8.5 | 25 | −4.6 | 454 (37) | 72.2 (0.4) | 71.2 (0.8) | 86.2 (0.1) | 83.0 (1.7) | 0.81 (0.02) | 8.8 (1.0) |
| NaCarb pH 10.5 | 45 | −0.1 | 427 (29) | 71.6 (0.5) | 72.0 (0.0) | 86.5 (0.1) | 93.9 (1.1) | 0.06 (0.03) | 7.3 (1.1) |

NaPhos. = sodium phosphate
NaCarb. = sodium carbonate

Treatment by each of the three buffers lightened fabric color and caused fabric shrinkage as evidenced by the increased fabric thickness and count. The fabric weights were, however, affected differently by these buffers. The sodium carbonate buffer did not change fabric weight whereas the sodium phosphate buffers reduced the fabric weight by 4 to 6%, which was about half of the weight lost from scouring. Except for the reduced yarn tenacity of the sodium carbonate treated cotton, the yarn tenacities resulting from the other two buffers were similar to those of scoured cottons. The moderate temperature and agitation employed in these buffer treatments were shown to cause fabric shrinkage without substantially changing the water wetting or retention properties of the cotton fabrics.

Therefore, it was demonstrated that the small effect from these buffers on the water wetting and retention properties of raw cotton fabrics minimized their interference with the evaluation of the effectiveness of the selected enzymes.

Example 3

This example details the treatment of cotton fabric with a range of enzyme types. Identical swatches of fabric were treated with four different enzymes including a pectinase, a cellulase, a protease, and a lipase. Following the treatment of the fabric, the enzymes were inactivated and the fabric was washed with buffer and dried. The dried fabric was characterized by measuring weight loss, thickness, fabric count, lightness, contact angle, water retention, linear density and tenacity.

Four types of enzymes, i.e., pectinase, cellulase, protease, and lipase (Genencor International, South San Francisco, Calif.), were investigated for their effectiveness in improving the water wetting and retention properties of cotton fabrics. The untreated raw cotton fabric was hydrophobic with a water CA of 93.9° (±3.30), and a water retention value of 0.15 μl/mg (±0.10). The fabric has a light yellow color (L*=85.1). Any of the buffers alone increase lightness in fabric color and fabric shrinkage, but have little or no effect on the water wetting and retention properties of raw cotton fabrics. Thus, the buffers did not interfere with the evaluation of the enzyme effects.

All enzyme treatments followed the same procedure and varied only in temperature and/or the buffer used. Each treatment with varying conditions was performed once to survey the effectiveness of the individual enzymes. Sodium phosphate buffers were used for the pectinase, cellulase, and lipase enzymes, and a sodium carbonate buffer was used for the protease enzyme (Table 6). Pectinase derived from *Aspergillus niger*, Cellulase was from Trichoderma, Protease was from Bacillus sp. (subtilisin type) and lipase was derived from *Pseudomonas mendocina*.

The buffer solution was brought to a constant temperature before the enzyme was added to the solution. All enzyme and buffer treatments lasted one hour while the mixer maintained homogeneity throughout the reaction period. At the end of each reaction, the sample was immersed in a rinse buffer for two minutes. The enzyme was inactivated by the pH of the rinse buffer. The fabric swatch was then centrifuged for 3 min. (International Clinical Centrifuge). Five alternating two-minute room-temperature water baths followed by three minute centrifuge treatments completed the rinsing process. The sample was then dried at 65% relative humidity and 70° F. Fabric weight during drying was monitored by weighing each sample every 24 hours until no change in weight was observed. This final weight ($W_t$) was obtained in 3 to 4 days, and was used to calculate the weight change according to Equation 1.

TABLE 6

| Enzyme reaction conditions | | | | | |
|---|---|---|---|---|---|
| Enzyme | pH | Temp. (° C.) | Enzyme Conc. (g/L) | Reaction Buffer | Rinse Buffer (pH) |
| Pectinase | 5.0 | 50 | unknown[Y] | 100 mM NaPhos. | 10 mM NaPhos. (8.0) |
| Cellulase | 5.0 | 50 | 5.0 | 100 mM NaPhos. | 10 mM NaPhos. (8.0) |
| Protease | 10.5 | 45 | 0.5 | 50 mM NaCarb | 10 mM NaPhos. (5.0) |
| Lipase | 8.5 | 25 | 0.6 | 100 mM NaPhos. | 10 mM NaPhos. (5.0) |

[Y]Pectinase contains an undetermined amount of cellulase

When examining the effects of enzymes on cotton fabrics, all comparisons were made with those fabric swatches treated in the corresponding buffer solutions without added enzyme. The lipase treatments had no effect on the water wetting and retention properties, nor the physical characteristics of the cotton fabric (Table 7). This lipase, under the conditions employed, was ineffective in improving the wetting properties of cotton. Therefore, no further investigation was made using this lipase.

The protease treatment also did not change fabric wetting properties, nor any of the fabric characteristics, i.e., thickness, fabric count, and lightness (Table 7). Interestingly, the protease treated cotton fabric had a markedly improved water retention value of 1.11 μl/mg. Little strength was lost with this protease treatment.

TABLE 7

| Effects of lipase and protease on cotton | | | | | | | | | |
|---|---|---|---|---|---|---|---|---|---|
| Enzyme | Weight Loss | Thickness | Fabric count | | Lightness | Contact angle | Linear Density | Water retention | Tenacity |
| (g/L) | (%) | (μm) | warp | fill | (*L) | (°) | (tex) | (μL/mg) | (N/tex) |
| Lipase (0.12) | −4.7 | 495 (27) | 72.8 (0.4) | 70.6 (0.5) | 86.0 (0.3) | 88.7 (1.3) | 18.3 (0.1) | 0.88 (0.0) | 9.5 (1.1) |
| Lipase (0.60) | −6.0 | 458 (41) | 72.0 (0.9) | 71.6 (0.7) | 86.1 (0.1) | 84.8 (2.8) | 18.8 (0.1) | 0.95 (0.04) | 9.1 (1.6) |
| Protease | −6.4 | 422 (23) | 71.8 (0.4) | 71.0 (0.7) | 86.4 (0.2) | 89.0 (1.2) | 18.7 (0.1) | 1.11 (0.09) | 8.1 (1.0) |

TABLE 8

| Enzyme (g/L) | Thickness (μm) | Fabric count warp | Fabric count fill | Lightness (*L) | Tenacity (N/tex) |
|---|---|---|---|---|---|
| Pectinase | 477 (37) | 72.4 (0.5) | 72.0 (0.0) | 86.0 (0.3) | 6.6 (1.2) |
| Cellulase | 456 (33) | 71.8 (0.4) | 71.6 (0.9) | 87.2 (0.1) | 6.4 (1.2) |
| Pectinase + Cellulase | 450 (25) | 71.6 (0.5) | 72.0 (2.0) | 86.3 (0.2) | 5.8 (1.2) |

Effects of pectinase and cellulase on cotton

Figure 1:
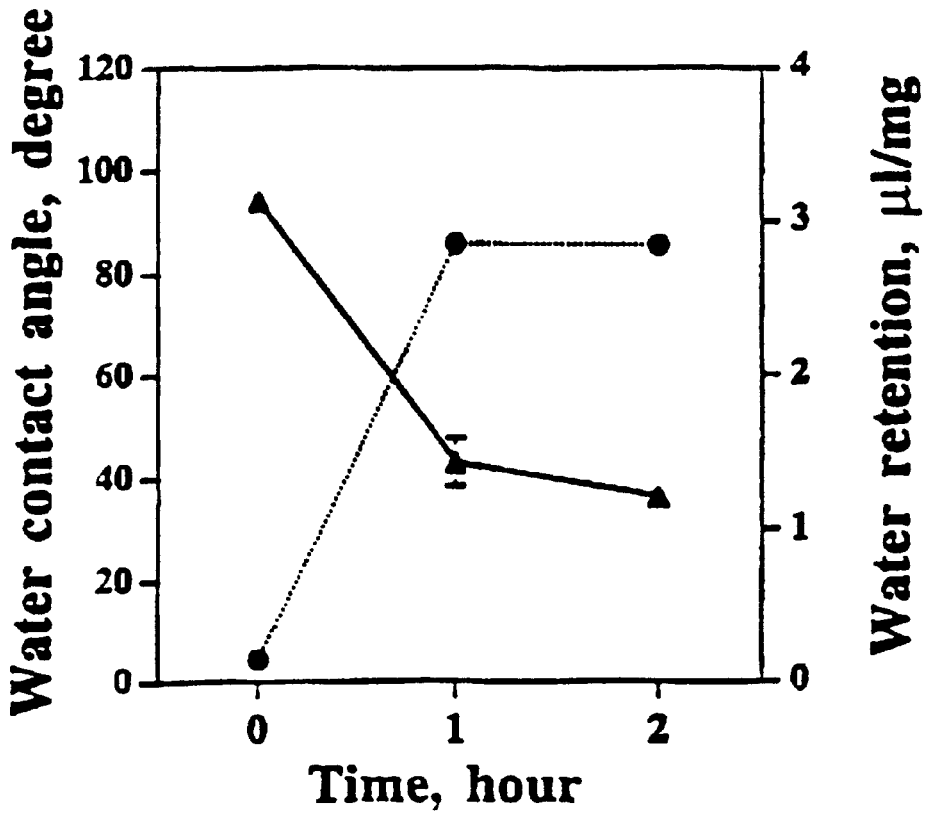
FIG. 1. Wettability (contact angle and water retention) of raw and scoured cotton fabrics ▼ water contact angle ● water retention FIG. 2. Effects of pectinase and cellulase treatment on the physical properties of cotton fabrics a. water contact angle b. water retention c. weight loss FIG. 3. Effects on the physical properties of cotton fabric of pectinase and cellulase treated fabric preceded by water pretreatment at 100° C.
Figure 2:
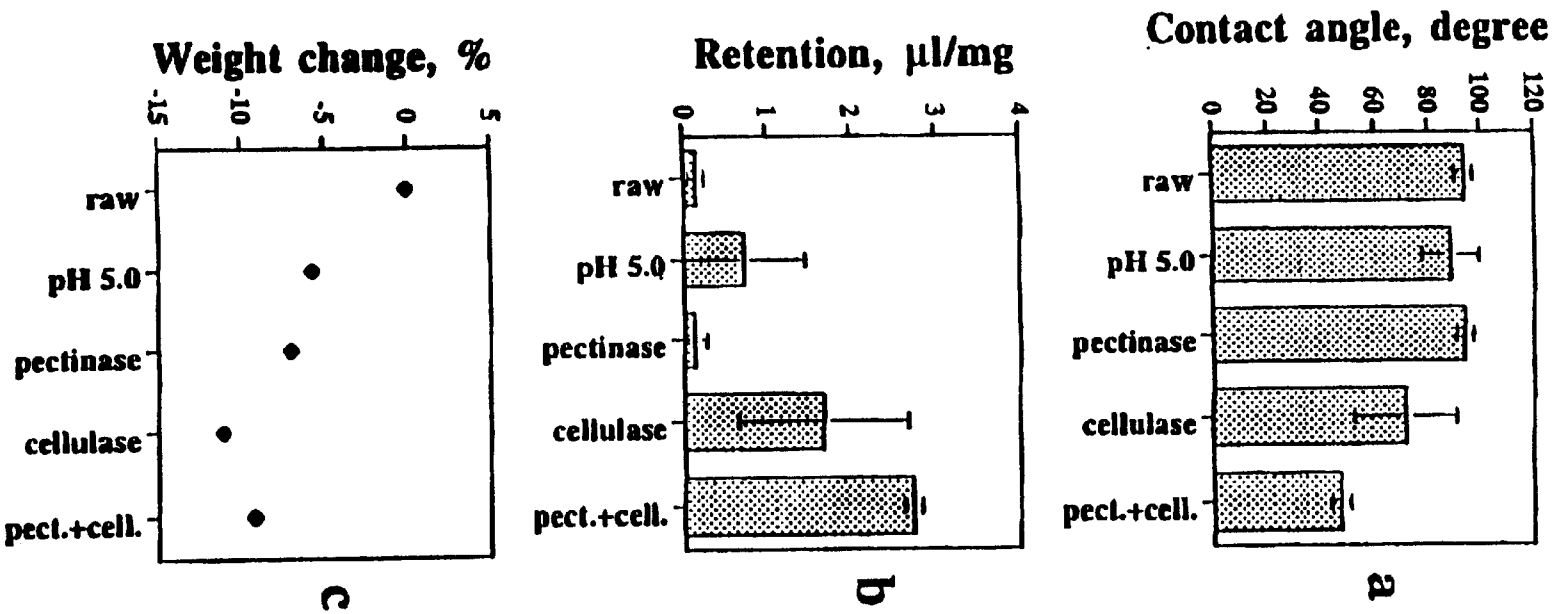

The pectinase, like the lipase, also showed no effect on the water CA, water retention, or other fabric characteristics, i.e., thickness, count and lightness (Table 8 and FIG. 2). A minimal weight loss was observed following treatment with the pectinase. The cellulase was the only enzyme which, when applied alone on raw cotton, produced detectable improvements in water wettability (CA) and water retention (FIG. 2*a*, 2*b*). Although there was no evidence of fabric shrinkage following cellulase treatment, fabric weight loss (FIG. 2*c*) and lightness (Table 8) were slightly increased. It appeared that the cellulase was able to gain access to the cellulose and remove the hydrophobic non-cellulosic components from the fabric surface.

The most significant improvement in wetting occurred when pectinase and cellulase were combined into a single treatment (Table 8 and FIG. 2). Both the water CA and water retention values fall within the range previously observed for commercially scoured fabrics (FIG. 2*a*, 2*b*). Weight loss (FIG. 2*c*) was less than that for cellulase alone, and the thickness, count and lightness did not change despite the improved wettability. The pectinase treatment only caused a slight decrease in yarn tenacity whereas cellulase significantly lowered yarn tenacity. The combined pectinase and cellulase treatment reduced the tenacity to lower than that of the cellulase treated sample.

The synergistic action of cellulase and pectinase in the combined treatment successfully improved the wetting properties of the cotton fabrics. Cellulase, which hydrolyzes the cellulose where possible, apparently assisted the action of pectinase by increasing its accessibility to the pectin materials. Access to the pectins may be gained by breaking down the cellulose which supports the noncellulosic components on the fiber surfaces. Thus, a synergistic effect between the cellulase and pectinase seems to suggest that some, if not all, pectins are located close to the secondary cell wall. If this is true, removing the pectins should release the other non-cellulosic components residing on the fiber surfaces.

This example demonstrates that lipases and pectinases have little effect on the wettability and other properties of cotton fabric. In contrast, treatment with cellulases improves both water wettability and water retention of cotton fabric. Interestingly, the most profound change in the physical properties of cotton fabric were produced by treatment with a mixture of cellulase and pectinase.

Example 4

This example illustrates the effects of treating cotton with boiling water both alone and followed by treatment with an enzyme.

4.1 Boiling Water

Figure 3:
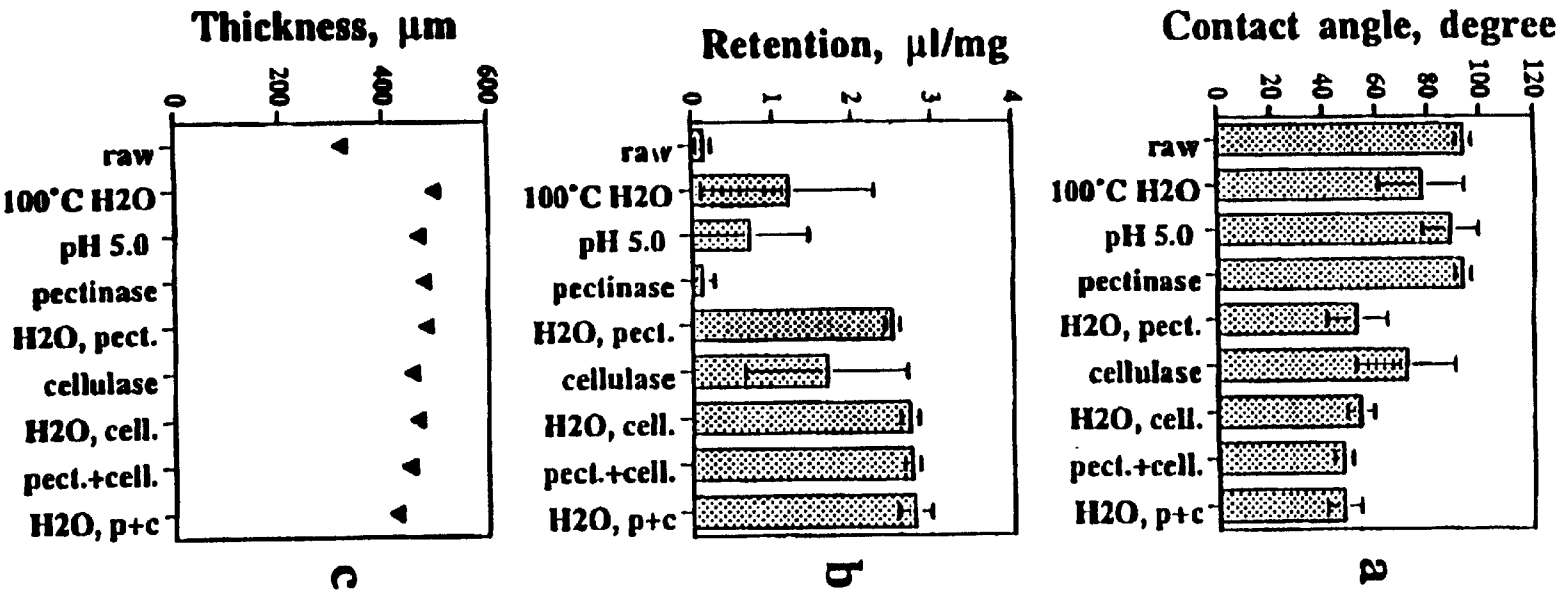

Three 2-minute immersions in water at 100° C. reduced the water CA of the cotton fabric by 16°, and increased the water retention value to 1.05 μl/mg (FIG. 3*a*, 3*b*). The large standard deviations of both values indicated that affected fiber surfaces were highly non-uniform in water wettability. The 100° C. water pretreatment on cotton fabric (Table 9) had effects on yarn tenacity and fabric lightness similar to those produced by scouring (Table 5). Weight loss was less, and the increased fabric thickness was greater for the briefly 100° C. water pretreated fabrics than for the scoured fabrics. Thus, scouring caused greater weight loss and shrinkage in the planar directions than the three 2-minute immersions into the 100° C. water.

TABLE 9

| Enzyme | Weight Loss (%) | Thickness (μm) | Fabric count warp | Fabric count fill | Lightness (*L) | Linear Density (tex) | Tenacity (N/tex) |
|---|---|---|---|---|---|---|---|
| None | −5.5 | 495 (28) | 72.0 (0.7) | 71.2 (0.4) | 86.5 (0.8) | 19.1 (0.1) | 8.4 (1.0) |
| Protease | −11.9 | 463 (10) | 72.8 (1.1) | 72.6 (0.9) | 86.6 (0.2) | 19.0 (0.0) | 7.6 (0.9) |
| Pectinase | −8.4 | 481 (1) | 72.0 (0.4) | 72.2 (0.4) | 86.2 (0.2) | 19.9 (0.1) | 6.2 (0.9) |
| Cellulase | −9.8 | 464 (21) | 73.2 (0.4) | 71.4 (0.4) | 86.9 (0.2) | 20.2 (0.1) | 5.9 (0.8) |
| Pectinase + Cellulase | −14.6 | 426 (21) | 72.0 (0.0) | 71.4 (0.5) | 86.6 (0.1) | 19.5 (0.1) | 5.2 (1.0) |

Effects of enzymes on 100° C. water-pretreated cotton 4.2 Boiling Water Followed by Enzyme Treatment The pectinase and cellulase treatments following water pretreatment at 100° C. improved the wetting properties of the cotton fabric more than when these enzymes were applied directly onto the raw cotton fabrics (FIG. 3*a*). This pretreatment apparently did not offer any additional advantages for the combined pectinase and cellulase treatment; the fabric CA already fell within a range of values comparable to those of commercially scoured cotton fabrics. This pretreatment also did not enhance the effects of the protease; no further improvements to the water wetting (83.2°±14.1) nor retention properties (1.32 μl/mg±1.09) were found when compared to the fabric treated with protease alone.

A water pretreatment at 100° C. enhanced the effectiveness of pectinase and cellulase enzymes. Wetting CAs of the pretreated fabrics were lower than those treated with the corresponding enzyme alone (FIG. 3*a*). This pretreatment enhanced the effects of the pectinase more so than the cellulase. These two enzymes, when applied individually on the raw cotton fabrics produced considerably different wetting properties. Their applications on pretreated cotton fabrics, however, resulted in the same wetting properties. Cotton fabrics treated with either pectinase or cellulase following a water pretreatment at 100° C. behave much like the combined pectinase and cellulase. These three enzymatic reactions produced cotton fabrics with water CAs and water retention values within a range of values common for commercially scoured cotton fabrics. Water wetting and retention data for the pretreated and cellulase treated fabric were less variant, indicating more uniform effects. For either pectinase or cellulase, the access to the pectins and cellulose in cotton was enhanced by the melting of the surface wax and lipids, and either redistributing these substances upon the fiber surfaces or dispersing them into the 100° C. water.

Since the pectinase combined with a 100° C. water pretreatment showed the greatest promise, the effects of pectinase treatment times were evaluated. When the treatment was reduced to 30 minutes, the water CA was 24° higher than following the 1 hour treatment, and the water retention was reduced approximately by 2 μl/mg (FIG. 4). The high standard deviation for the water CA indicated nonuniform activity over the fabric surface. Reducing the treatment time further to 10 minutes rendered the pectinase ineffective. Under the conditions studied, reaction with this pectinase needed to be longer than 30 minutes to produce wetting properties similar to alkaline scoured cotton.

In summary, the pretreatment in water at 100° C. enhanced the effects of the individual pectinase and cellulase reactions on cotton fabrics, but not the combined pectinase-and-cellulase treatment. The most improved water wetting and retention properties with the least strength reduction of the cotton fabric was achieved by combining the water pretreatment with a pectinase reaction. Among the enzymes evaluated in this study, the pectinase combined with a pretreatment shows the most promise as an alternative to alkaline scouring. The use of enzymes to hydrolytically remove the non-cellulosic components of the cotton fiber offers many potential benefits over the current alkaline scouring process. Enzymatic reactions expand the flexibility in textile processing because of the wider range of reaction conditions, such as pH, time, and temperature. The temperatures for effective enzymatic reactions were far below those employed in alkaline scouring, thus having significant advantage in energy consumption.

Polyester Fabric

Examples 5–10 below, illustrate the use of the techniques of the instant invention on a range of polyester fabrics. Four polyester fabrics were used in this study. The homopolymer poly(ethylene terephthalate) (PET) (Dacron 54, du Pont de Nemours & Co.) was used for the evaluation of lipases and for the optimization of reaction conditions. Three other polyesters used were the sulfonated PET (SPET, Dacron 64) and heat set sulfonated PET (du Pont de Nemours & Co.) and microdenier PET (Micromattique™, du Pont de Nemours & Co.). The SPET was a copolymer containing a low content (2–3%) of sulfonated groups on the benzene ring. The microstructure and macrostructure of sulfonated poly (ethylene terephthalate) (SPET) fibers has been studied. Timm, D. A., et al., *Journal of Polymer Science, Part B: Polymer Physics Edition*, 31:1873–1883 (1993). All of the polyester fabrics had a plain weave structure. The PET and SPET fabrics consisted of staple yarns and the microdenier PET fabric contained Micromattique™ polyester filaments. The properties of the untreated polyester fabrics are shown in Table 10.

TABLE 10

Polyester fabric characteristics

| Parameter Measured | PET Dacron 54 | SPET Dacron 64 | Heat set SPET | Microdenier PET |
|---|---|---|---|---|
| Fabric weight, mg/cm2 | 11.60 | 16.69 | 16.60 | 6.5 |
| Thickness meas., cm | 0.0297 | 0.0431 | 0.0448 | 0.0164 |
| Fabric count, yarns/inch | 78 × 70 | 48 × 42 | 48 × 42 | 115 × 104 |
| Bulk density, g/cc | 0.3903 | 0.3872 | 0.3703 | 0.3974 |
| Fiber density, g/cc | 1.3841 | 1.38 | 1.38 | 1.3942 |
| Porosity (calc.) | 0.718 | 0.719 | 0.732 | 0.715 |
| $C_1$, μl/mg | 1.84 | 1.85 | 1.98 | 1.80 |
| $C_m$, μl/mg | 1.88 | 1.49 | 1.27 | 1.70 |
| $C_v$, μl/mg | 1.32 | 1.45 | 1.27 | 1.70 |

Physical properties including % weight change, fabric thickness, water contact angles, water retention and liquid retention capacity were calculated using the techniques and equations described above. Additional parameters were determined as detailed below.

Fiber densities were measured in a gradient density column filled with $CC1_4$ and n-heptane at 21° C. Timm, D. A., et al., *Journal of Polymer Science, Part B*: Polymer Physics Edition, 31:1873–1883 (1993). Fiber radius was measured using a microscope equipped with a calibrated micrometer. The weight, count, and thickness of the fabrics were measured using a standard method (ASTM 1910).

Five lipases were used (Table 11). Lipases A, B, C, and D were commercially available (ICN and Sigma). Lipase E was isolates from *Ps. mendocina* and was obtained from Genencor International. Enzyme reactions on the PET fabrics were performed in aqueous buffer solutions. Two buffers, organic tris(hydroxymethyl)aminomethane and an inorganic sodium phosphate, were initially tested. The inorganic phosphate buffer was selected and used throughout this study.

Each fabric sample was cut and raveled to a dimension of 10 cm by 14 cm. Fabrics of this dimension weigh approximately 1 g. A 0.33:1 (L/g) liquor:fabric ratio was employed for the enzyme and buffer treatments. The effects of hydrolysis on these fabrics were investigated by varying the conditions of hydrolysis, i.e., concentration, pH, temperature, and length of reaction time. The enzyme activity was terminated by rinsing the fabrics in buffer having a pH value at which the enzyme was inactive. All fabrics were then rinsed with water and dried for 12 hours at 60° C. under vacuum and stored at 21° C. and 60% relative humidity for 24 hours before being further characterized.

TABLE 11

Lipases and their properties

| Lipase | Manufacturer | Source | Form | Activity ($mg^{-1}$ solid) |
|---|---|---|---|---|
| A | ICN | Hog pancreas | powder | 30.8 unit[a] |
| B | ICN | Porcine pancreas | powder | 16 unit[a] |
| C | Sigma | Wheat germ | powder | 7.6 unit[b] |
| D | Sigma | *Candida cylindracea* | powder | 250,000 unit[c] |
| E | Genencor International | Ps. *mendocina* | liquid | — |

[a]One unit will liberate 100 μmoles fatty acid per hour (pH 7.8, 37° C.) using olive oil emulsion as substrate.
[b]One unit will hydrolyze 1.0 micro-equivalent of fatty acid (pH 7.4, 37° C.) from triacetin in one hour.
[c]One unit will hydrolyze 1.0 micro-equivalent of fatty acid (pH 7.2, 37° C.) from olive oil in one hour.

Example 5

This example illustrates the absorption by PET of aqueous solutions of buffers, including tris(hydroxymethyl)

aminomethane and sodium phosphate. Also explored was the binding of a denatured, and hence inactive, lipase to the PET fabric. The results are summarized in FIG. 5.

The water wetting contact angle and the water retention value of the untreated PET was 75.8° (±5°). The water and liquid retention capacities of the untreated PET were 0.229 (±0.06) μl/mg and 1.219 μl/mg, respectively. This indicated that water occupied about 19% of the liquid retention capacity of the untreated polyester fabric. The effects of buffers alone, one organic and the other inorganic, were examined first. The PET fabrics were immersed in the individual buffers at 35° C. for 1 hour. The organic buffer tris(hydroxymethyl)aminomethane (100 mM), lowered the wetting contact angle of the polyester fabrics to 67.5° (±1.5°). The inorganic buffer, sodium phosphate (100 mM), increased the wetting contact angle to 81.9° (±1.4°). The adverse effect of the inorganic buffer on the wetting contact angle of the polyester fabric was thought not to interfere with the enzyme effect. Thus, the inorganic phosphate buffer was used with all lipases in this study.

The PET fabric was also exposed to a denatured lipase solution (0.6 g/L) in sodium phosphate buffer. An increased water contact angle indicated possible adsorption of a hydrophobic substance, i.e., protein and/or other compounds, from the solution to the fabric surface. Like the inorganic buffer, the effect of exposure to the denatured protein on wetting was adverse. As any possible protein adsorption would, therefore, only impede and not enhance the apparent hydrolyzing effects of the lipases, any improvement in surface wetting would have to be due to the hydrolyzing action of the lipases.

Example 6

Example 6 details the initial reaction of PET fabric with a lipase. The reaction using lipase E was not optimized and was intended only to investigate the potential of this lipase for altering the characteristics of the PET fabric.

PET fabric was treated with lipase E (0.6 g/L, 35° C., 1 hour), which significantly improved the water wetting and retention properties while not imposing adverse effects on strength of the PET fabrics. The water wetting contact angle was reduced to 57.4° (±2.3°) and the water retention was increased to 1.06 (±0.05) μl/g. The yarns from the untreated PET fabric has a breaking tenacity of 3.17 g/d (±0.93) and a breaking strain of 24.6% (±3.2). The breaking tenacity and strain of the yarns from the lipase E treated PET fabric were 3.10 g/d (±0.92) and 27.0% (±3.0), respectively, indicating insignificant differences.

The lipase reaction produced a more consistent and better wetting surface than aqueous alkaline hydrolysis. Alkaline hydrolysis of the PET fabric under the optimal condition (3N NaOH at 55° C. for 2 hours) produced a water contact angle of 65.0° (±8.0°) and water retention value of 0.32 (±0.01) μl/g. The PET yams from fabric hydrolyzed by sodium hydroxide have a reduced breaking tenacity of 2.78 g/d (±5.29) and a much increased breaking strain of 42.5% (±1.8).

The polyester fabrics reacted with lipase E in the sodium phosphate buffer showed clearly improved water wettability. The lipase E improved the water wetting and absorption of the polyester fabrics more than the alkaline hydrolysis reaction. The enzyme reaction was also shorter. The improved water wettability was accompanied by full strength retention in contrast to the reduced strength and mass from alkaline hydrolysis.

Example 7

In this example, the procedure for optimizing the reaction between PET fabric and lipase E is detailed. Samples of PET fabric were treated with solutions having identical concentrations of lipase E for varying amounts of time. Following the reaction, the characteristics of the treated fabric were determined. Once an optimal reaction time was determined, the concentration of the enzyme was varied. Thus, an optimal reaction time and enzyme concentration were determined for lipase E. The results are summarized in FIG. 6 and Table 12.

The PET fabrics were treated with lipase E at a concentration of 0.12 g/L at 35° C. for 10, 30, and 60 minutes. The water contact angle was drastically reduced and water retention was increased more than four-fold after only ten minutes of reaction (Table 12). Prolonging the reaction time did not lead to further improvement. Increasing reaction time appeared to cause slightly increased weight loss, thickness reduction, porosity, and liquid retention capacity. These changes were, however, very small.

TABLE 12

Effects of reaction time on wetting and absorbent properties of lipase E[1] treated PET fabrics

| Time (min) | Δ Weight (%) | Thickness (μm) | Porosity | WCA, (°) | Water (μl/mg) | Liquid Retention Capacity (μl/mg) | Water/ Capacity |
|---|---|---|---|---|---|---|---|
| 0 | 0 | 332.7 (±27.3) | 0.727 | 75.8 | 0.229 | 1.22 | 0.188 |
| 10 | 0.29 | 337.3 (±12.4) | 0.732 | 52.3 | 0.980 | 1.39 | 0.683 |
| 30 | 0.40 | 326.1 (±12.2) | 0.723 | 56.8 | 0.891 | 1.44 | 0.621 |
| 60 | 0.45 | 317.5 (±9.1) | 0.715 | 51.9 | 0.944 | 1.43 | 0.651 |

[1]The lipase concentration was 0.12 g/L.

At a constant reaction time of 10 minutes, water wettability and retention properties were further enhanced when the enzyme concentration was increased (FIG. 6*a*, 6*b*). The improvement in water wetting and retention properties was slightly higher at 35° C. than at 25° C. A 58.3° water contact angle and 0.90 μl/mg water absorbency can be produced by treating the regular polyester fabric in lipase E at 35° C. for 10 minutes at a concentration of 0.03 g/L. In comparison with alkaline hydrolysis, the lipase treatment produced more pronounced wetting improvement at much lower temperatures. The water/liquid capacity ratios and water contact angles from fabrics treated at both reaction temperatures followed the same linear relationship (FIG. 6*c*). Since these reactions did not cause significant change in fabric weight, changes in porosity were expected to be nil. This observation reconfirmed that the water retention in fabrics with similar pore structure and overall porosity depend highly on the water wetting properties of the solid media.

Example 8

This example describes the treatment of microdenier PET with lipase E under the optimal conditions determined in Example 7. Profound changes in the wettability and other properties of the microdenier fabric are observed following treatment with a lipase.

The microdenier fabric was treated with lipase E (0.03 g/L. 35° C., 10 minutes). The water contact angle was reduced to 35.9 (±4.0) and the water absorbency was increased to 1.26 μl/mg (±0.02). Compared to the PET fabric treated under the same condition (58.3° WCA and 0.90 μl/mg water absorbency), the improvement in water wetting and absorbency on the microdenier fabrics was much greater. This corresponded to the preferential effects of aqueous alkaline hydrolysis on the microdenier fabrics. Both alkaline and enzymatic hydrolysis caused more significant improvement in the water wetting behavior of the microdenier PET fabric than in that of its PET counterpart.

Thus, treatment with a lipase is particularly effective at altering the wetting characteristics of microdenier polyester fabrics.

Example 9

Example 9 demonstrates the effects on the PET fabrics of various commercially available lipases (lipases A, B, C, D from Table 11). Initial experiments isolated lipase A as the most effective of the lipases. Thus, in succeeding experiments, the concentration of lipase A was varied to assess the dependence on concentration of its effectiveness in altering the properties of the PET fabric.

Four commercially available lipases were used to treat the PET fabrics. These lipases were obtained in powder form. Solutions with a concentration of 0.125 g/L were used. All treatments were performed using phosphate buffer at pH 8.5 and at a temperature of 35° C. for 10 minutes. The order of effectiveness in improving the wetting properties of polyester was A>B>C, with both lipases A and B more effective than lipase E (FIG. 7).

Varying concentrations of lipase A were evaluated (35° C., 10 minutes). The water wetting contact angle decreased and the water retention increased with higher concentration (FIG. 8*a*). At 1 g/L, the reaction temperature was varied between 25° C. and 45° C. The water wetting contact angle decreased and the water retention increased with increasing temperatures between 25° C. and 35° C. (FIG. 8*b*). At higher temperatures of 40° C. and 45° C., the effects of lipase A reduce to levels similar to those around 30° C. In comparison to alkaline hydrolysis (CA=65.0°±8.0°), similar yet more consistent wetting properties (CA=67.6°±0.3°) were attained at a very low concentration (0.01 g/L) of lipase A. At a higher concentration of 0.1 g/L, a much superior water contact angle of 54.9° was produced.

A low 38.4° (±3.1°) water contact angle and a high 1.06 ml/g water retention value was achieved after reaction with a 1 g/L concentration of lipase A at 35° C. for 10 minutes. Such a low wetting contact angle has never been reported on hydrolyzed PET surfaces. This level of wetting was similar to that obtained on the microdenier fabrics which was treated at about a third of the concentration. These results suggest that the surface effects were directly related to the proportion of surface area and amount of the active agent. For any surface modification, the persistence of the acquired wettability was of great interest. The water contact angle and retention of the same PET fabrics measured 84 days after the reaction were 45.0° (±0.4°) and 0.98 μl/mg (±0.06). Although the water contact angle increased slightly, the surface wettability and water retention remain far superior to any PET surfaces hydrolyzed by aqueous alkaline hydrolysis.

Lipase A was also applied to PET fabrics at a range of concentrations in water without any buffer (pH=7.0). Water contact angles decrease and water retention increased with increasing lipase concentrations (FIG. 9). At 25° C., the improvement of wetting contact angle was actually slightly greater at the low end of the concentration range. This trend reversed with increasing concentrations above 0.25 g/L at 35° C. The reactions in water were slightly less effective, but follow the same general trend as those in the buffer solution. At comparable enzyme concentrations, water contact angles of fabrics treated in water were 5 to 10 degrees higher than those treated in the buffer. The water contact angle of the lipase A treated PET fabric (1 g/L, 35° C., water) was 43.2°, 44.3°, 45.9°, 45.1", immediately, 1, 2, and 3 months following the reaction, respectively. The treated surfaces retained the acquired wettability for at least three months.

The optimal reaction conditions for lipase A (1 g/L at 35° C.) were employed in treating the three other polyester fabrics (Table 13). Improvement on wetting contact angle as well as water retention was clearly seen on all four types of polyester fabrics. The untreated sulfonated PET and untreated heat set sulfonated PET had water contact angles in the low-to-middle 60s. These contact angles were lower than the regular and microdenier polyester fabrics. This was likely due to the polar nature of the sulfonated group —$SO_3Na^+$), even though only 2 to 3% of the aromatic rings in SPET were sulfonated. For PET and sulfonated PET fabrics, the improvement in wettability was slightly better when the reactions were conducted in the pH 8.0 buffer (FIG. 10). No difference was found for the heat set SPET and the microdenier PET fabrics whether the reactions were conducted in buffer or not. Water contact angles fall in between 38.4° to 49.6° for those treated in the buffer whereas water contact angles were between 45.2° to 49.4° among those treated in water.

TABLE 13

Effects of lipase A (1 g/L, pH = 8.35° C. , 10 min) on polyester fabrics

| Polyester | WCA, degree | Water, (μl/mg) | Liquid Retention Capacity, μl/mg | Water/ Capacity |
|---|---|---|---|---|
| Dacron 54 | 75.8 | 0.23 | 1.32 | |
| untreated | (0.5) | (0.06 | (0.01) | 0.17 |
| lipase A | 38.4 | 1.06 | 1.43 | |
| | (2.5) | (0.01) | (0.07) | 0.74 |
| Dacron 64 | 63.9 | 0.78 | 1.45 | |
| untreated | (5.8) | (0.10) | (0.04) | 0.54 |
| lipase A | 42.9 | 1.20 | 1.41 | |
| | (4.1) | (0.05) | (0.04) | 0.85 |
| Dacron 64 heat set | 61.0 | 0.43 | 0.82 | |
| untreated | (3.4) | (0.04) | (0.03) | 0.53 |
| lipase A | 44.9 | 0.60 | 0.85 | |
| | (3.0) | (0.01) | (0.01) | 0.71 |

TABLE 13-continued

Effects of lipase A (1 g/L, pH = 8.35° C. , 10 min) on polyester fabrics

| Polyester | WCA, degree | Water, (μl/mg) | Liquid Retention Capacity, μl/mg | Water/ Capacity |
|---|---|---|---|---|
| Microdenier PET | 75.5 | 0.26 | 1.40 | |
| untreated | (11.8) | (0.10) | (0.02) | 0.18 |
| lipase A | 49.6 | 1.10 | 1.37 | |
| | (4.1) | (0.08) | (0.04) | 0.80 |

Example 10

In this example, the relationship between water retention and water contact angle in a series of enzyme treated polyester fabrics was explored.

On both of the regular PET fabrics hydrolyzed with lipase E and three polyester fabrics treated with lipase A, the water retention or absorbency was positively related to surface wettability or negatively related to the water contact angles (FIG. 11). Similar relationships between these two parameters for PET and mPET fabrics hydrolyzed in aqueous sodium hydroxide under varying reaction times and temperatures were known. These previously reported water wetting and retention data on the alkaline hydrolyzed PET and mPET were combined and also presented in FIG. 7. Alkaline hydrolysis has been shown to reduce fabric weight, thus significantly altering the pore structure of the fabrics. The enzyme reactions, on the other hand, caused a weight loss of only 0.13% on the average. Therefore, the enzyme treated fabrics had a pore structure essentially unchanged from their untreated counterparts. In the case of lipase treated polyester fabrics, similar absorbency-wettability relationships were also found among fabrics with essentially the same pore structure (■) lipase E on PET and among fabrics with considerably different pore structure (□) lipase A on PET, SPET, and mPET).

Example 11

This example demonstrates a method for determining the extent of binding of a lipase to a polyester fabric swatch. The protocol was designed to assess the affinity of 10 lipases from different sources for a polyester substrate. Briefly, a lipase was allowed to bind to a polyester substrate. The polyester-lipase construct was subsequently reacted with a solution of a chromogenic substrate such as p-nitrophenylbutyrate and the absorbance of the solution was measured at 410 nm. The intensity of the absorbance at 410 nm was assumed to be proportional to the amount of lipase bound to the polyester substrate.

An aqueous solution of an enzyme (0.5 μg/mL, lipase from *Ps. mendocina*)was prepared. A sample of commercially available polyester fabric (1"×1") was immersed in the enzyme solution for one minute. The fabric sample was removed from the enzyme solution and air dried for 3 h. The fabric sample was then transferred to a 50 mL beaker which contained p-nitrophenylbutyrate (1 mM in tris buffer, pH 7). Aliquots (1 mL) of this solution were withdrawn every minute for 5 min and the absorbance at 410 nm of each of the aliquots was determined. Thus, the rate of reaction between a polyester-bound enzyme and the p-nitrophenylbutyrate were determined (FIG. 12).

In the above example, an assay is described which allows an enzyme's avidity for polyester fabric to be determined. The data from this assay can be used to assist in choosing an enzyme with binding characteristics appropriate to the fabric chosen. It will be clear to one of skill in the art that the above-described assay can be extended to multiple solutions wherein each solution contains a different enzyme. Following normalization of the enzyme solutions to equal activity on a chromogenic substrate (e.g., p-nitrophenylbutyrate), the extent of enzyme binding to polyester fabric will be assessed as described above.

In summary, the effects several enzyme types on improving the wettability and water retention properties of cotton fiber. The greatest improvement was observed for combinations of cellulase and pectinase. Further, the action of hydrolyzing enzymes on improving the hydrophilicity of several polyester fabrics have been studied. Four out of the five lipases studied improve the water wetting and absorbent properties of the regular polyester fabrics. The enzymatic hydrolysis significantly improved the water wetting and retention properties of the PET fabrics, more so even than alkaline hydrolysis. For instance, a 10-minute reaction (1 g/L, pH 8.0, 35° C.) reduces the water wetting contact angle of the regular PET from 75.8° to 38.4° (±2.5) and increases the water retention from 0.22 μl/mg to 1.06 μl/mg. Alkaline hydrolysis of the PET fabric under the optimal condition (3N NaOH at 55° C. for 2 hours) produced a water contact angle of 65.0° (±8.0) and water retention value of 0.32 (±0.01) μl/mg. Reaction conditions have been optimized for two of the lipases, i.e. A and E. The enzyme reaction have shown to be effective under more moderate conditions, including a relatively shorter reaction time (10 minutes), at ambient temperature (25° C.), and without the use of buffer. The improved water wettability was accompanied by full strength retention as compared to the reduced strength and mass from alkaline hydrolysis. Lipase E was also effective in improving the wetting and absorbent properties of sulfonated polyester and microdenier polyester fabrics.

The foregoing is offered primarily for purposes of illustration. It will be readily apparent to those skilled in the art that the operating conditions, materials, procedural steps and other parameters of the system described herein can be further modified or substituted in various ways without departing from the spirit and scope of the invention.

We claim:

1. A method of enhancing a physical property of a polyester fiber, said physical property selected from water wettability, water absorbancy and combinations thereof, said method comprising:

(a) treating said polyester fibers with an aqueous solution of a lipase at a first pH thereby enhancing said physical property of said polyester fiber; and (b) following step (a), contacting said polyester fiber with an aqueous solution having a second pH different from said first pH.

2. A method in accordance with claim 1 wherein said aqueous solution of a lipase further comprises an inorganic buffering agent.

3. A method in accordance with claim 2 wherein said aqueous solution of a lipase is at a pH of from about 5.0 to about 9.5.

4. A method in accordance with claim 2 wherein said aqueous solution of a lipase is at a pH of from about 5.0 to about 7.5.

5. A method in accordance with claim 2 wherein said aqueous solution of a lipase is at a pH of from about 7.5 to about 9.5.

6. A method in accordance with claim 1, wherein said second pH is from about 2.0 to about 5.5.

7. A method in accordance with claim 1 which said aqueous solution of a lipase has a concentration of from about 0.01 g/L to about 1.0 g/L.

8. A method in accordance with claim 1 in which said treatment is conducted at a temperature of from about 20° C. to about 80° C.

9. A method in accordance with claim 1 in which said treatment is conducted at a temperature of from about 25° C. to about 35° C.

10. A method according to claim 1, wherein said lipase has significant polyester binding activity.

11. A method according to claim 1, wherein said polyester is a member selected from the group consisting of fibers, solvent-spun fibers, filaments, threads, yarns and textile fabrics wherein said textile fabrics are members selected from the group consisting of woven, nonwoven and knit textile fabrics.

12. Aromatic polyester fiber produced by the method of claim 1.

* * * * *